US008750753B2

(12) United States Patent
Itabashi

(10) Patent No.: US 8,750,753 B2
(45) Date of Patent: Jun. 10, 2014

(54) PROCESS UNIT AND IMAGE FORMING DEVICE

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 154 days.

(21) Appl. No.: 13/188,488

(22) Filed: Jul. 22, 2011

(65) Prior Publication Data

US 2012/0039633 A1 Feb. 16, 2012

(30) Foreign Application Priority Data

Aug. 11, 2010 (JP) ..... 2010-180320

(51) Int. Cl.
*G03G 15/08* (2006.01)

(52) U.S. Cl.
USPC ..... 399/111; 399/119; 399/120

(58) Field of Classification Search
USPC ..... 399/110, 113, 222, 108
See application file for complete search history.

(56) References Cited

U.S. PATENT DOCUMENTS

| | | | | |
|---|---|---|---|---|
| 5,078,303 | A | 1/1992 | Kikuchi et al. | |
| 5,506,665 | A * | 4/1996 | Ishida et al. | 399/119 |
| 5,608,501 | A | 3/1997 | Makino | |
| 6,185,401 | B1 | 2/2001 | Kanamori et al. | |
| 7,437,095 | B2 | 10/2008 | Shimomura et al. | |
| 7,747,192 | B2 | 6/2010 | Sato | |
| 8,073,357 | B2 | 12/2011 | Sakuma | |
| 2005/0271425 | A1 | 12/2005 | Shimomura et al. | |
| 2006/0257163 | A1 | 11/2006 | Sato | |
| 2007/0223963 | A1 | 9/2007 | Suzuki et al. | |
| 2007/0223964 | A1 | 9/2007 | Takagi | |

(Continued)

FOREIGN PATENT DOCUMENTS

| | | |
|---|---|---|
| JP | 45-033480 | 10/1970 |
| JP | 01-108581 | 4/1989 |

(Continued)

OTHER PUBLICATIONS

Office Action issued in corresponding Japanese Patent Application No. 2010-180320 dated Jul. 24, 2012.

*Primary Examiner* — Clayton E Laballe
*Assistant Examiner* — Victor Verbitsky
(74) *Attorney, Agent, or Firm* — Banner & Witcoff, Ltd.

(57) ABSTRACT

A process unit includes: a photosensitive member; a developing unit; a developer cartridge; a guide portion; and an operation portion. The photosensitive member has a surface. The developing unit has a developing agent bearing member for bearing a developing agent to be supplied to the surface of the photosensitive member. The developer cartridge includes a casing defining an internal space for accommodating the developing agent, and a pressed portion provided at the casing and configured to be pressed by an external force. The developer cartridge is mountable on or detachable from the developing unit in a first direction, and further configured to be pressed in a second direction different from the first direction upon application of pressure to the pressed portion by the external force. The second direction is coincident with a direction of pressing the developing agent bearing member against the surface of the photosensitive member. The guide portion is shiftable between a first posture for guiding the developer cartridge to move relative to the developing unit in the first direction, and a second posture for guiding the developer cartridge to move relative to the developing unit in the second direction. The operation portion is configured to be operated to selectively shift the guide portion to one of the first posture and the second posture.

11 Claims, 14 Drawing Sheets

(56) References Cited

U.S. PATENT DOCUMENTS

| | | | | |
|---|---|---|---|---|
| 2007/0223965 | A1 | 9/2007 | Takagi | |
| 2007/0223971 | A1 | 9/2007 | Takagi | |
| 2008/0075506 | A1* | 3/2008 | Sato | 399/262 |
| 2009/0245854 | A1 | 10/2009 | Sakuma | |
| 2010/0329734 | A1 | 12/2010 | Hayakawa et al. | |

FOREIGN PATENT DOCUMENTS

| | | |
|---|---|---|
| JP | 03-196074 | 8/1991 |
| JP | 06-222629 | 8/1994 |
| JP | 07-225514 | 8/1995 |
| JP | 08-305148 | 11/1996 |
| JP | 11-194600 | 7/1999 |
| JP | 2005-338642 | 12/2005 |
| JP | 2006-276233 | 10/2006 |
| JP | 2006-343359 | 12/2006 |
| JP | 2007-293268 | 11/2007 |
| JP | 2009-020375 | 1/2009 |
| JP | 2009-237252 | 10/2009 |
| JP | 2011-013367 | 1/2011 |

* cited by examiner

TOP
REAR
RIGHT
LEFT
FRONT
BOTTOM
51
52
66
65
(65R)
65
(65L)
66
112
55
60
54
61
56
112
111
53
85
85
85

PROCESS UNIT AND IMAGE FORMING DEVICE

CROSS REFERENCE TO RELATED APPLICATION

This application claims priority from Japanese Patent Application No. 2010-180320 filed Aug. 11, 2010. The entire content of the priority application is incorporated herein by reference.

TECHNICAL FIELD

The present invention relates to an image forming device such as a laser printer and a process unit mounted in the image forming device.

BACKGROUND

A conventional laser printer has a main casing, and, within the main casing, a process unit retaining a photosensitive drum and a developing roller is detachably mounted. A toner box in which toner is accommodated is mounted in the process unit.

The photosensitive drum and the developing roller are disposed in the process unit such that a circumferential surface of the photosensitive drum is in contact with a circumferential surface of the developing roller. The process unit has a curved wall at a position opposite the photosensitive drum relative to the developing roller. The curved wall is formed so as to conform to an outline of the toner box. The process unit is further provided with a toner box accommodating chamber for accommodating the toner box at a position opposite the photosensitive drum and the developing roller relative to the curved wall. The toner box accommodating chamber includes a shutter movable along the curved wall. The curved wall is formed with a toner inlet port penetrating the curved wall. The curved wall has a surface confronting the shutter, and a seal member is affixed to the surface to encircle the toner inlet port. That is, the seal member is formed with a seal opening aligned with the toner inlet port.

The toner box is mounted in the toner box accommodating chamber in alignment with the photosensitive drum and the developing roller. After the toner box has been mounted in the toner box accommodating chamber, the toner box is pressed toward the curved wall in the alignment direction, that is, a direction the same as a mounting direction of the toner box with respect to the toner box accommodating chamber. Then, the shutter is moved to a position displaced from the toner inlet opening.

As a result, the shutter is displaced from a position between the seal member and the toner box, and the seal member and the toner box are brought into pressure contact with each other. Consequently, the periphery of the toner inlet port is sealed between the curved wall and the toner box by the seal member. In this state, the interior of the toner box and a space in which the photosensitive drum and the developing roller are accommodated have a fluid communication with each other through the toner inlet port, allowing toner to fluidly circulate between the space and the interior of the toner box.

SUMMARY

However, with the above-described structure, the mounting direction of the toner box is the same as the pressing direction of the toner box with respect to the curved wall. If the mounting direction and the pressing direction can be independently determined, enhanced degree of freedom in design of the process unit can be obtained. However, if the mounting direction is different from the pressing direction, a structure for allowing the toner box to move both in the mounting direction and the pressing direction is required. Because, when the toner box is mounted in the toner box accommodating chamber, movement of the toner box in the mounting direction should be allowed, and when the toner box is positioned in the toner box accommodating chamber, movement of the toner box in the pressing direction should be allowed.

In view of the foregoing, it is an object of the present invention to provide a process unit allowing a developer cartridge to move in two directions and capable of reliably moving the developer cartridge in each direction, and an image forming device provided with the process unit.

In order to attain the above and other objects, the present invention provides a process unit including: a photosensitive member; a developing unit; a developer cartridge; a guide portion; and an operation portion. The photosensitive member has a surface. The developing unit has a developing agent bearing member for bearing a developing agent to be supplied to the surface of the photosensitive member. The developer cartridge includes a casing defining an internal space for accommodating the developing agent, and a pressed portion provided at the casing and configured to be pressed by an external force. The developer cartridge is mountable on or detachable from the developing unit in a first direction, and further configured to be pressed in a second direction different from the first direction upon application of pressure to the pressed portion by the external force. The second direction is coincident with a direction of pressing the developing agent bearing member against the surface of the photosensitive member. The guide portion is shiftable between a first posture for guiding the developer cartridge to move relative to the developing unit in the first direction, and a second posture for guiding the developer cartridge to move relative to the developing unit in the second direction. The operation portion is configured to be operated to selectively shift the guide portion to one of the first posture and the second posture.

According to another aspect, the present invention provides an image forming device including: a main casing; and the above-described process unit. The process unit is detachably attached to the main casing.

BRIEF DESCRIPTION OF THE DRAWINGS

The particular features and advantages of the present invention as well as other objects will become apparent from the following description taken in connection with the accompanying drawings, in which:

FIG. 14 is a perspective view of an operation guide unit provided in a drawer unit in which the toner cartridge shown in FIG. 13 is mounted;

DETAILED DESCRIPTION

Next, an image forming device according to one embodiment of the present invention will be described while referring to the accompanying drawings.

1. Structure of Color Printer

Figure 1:
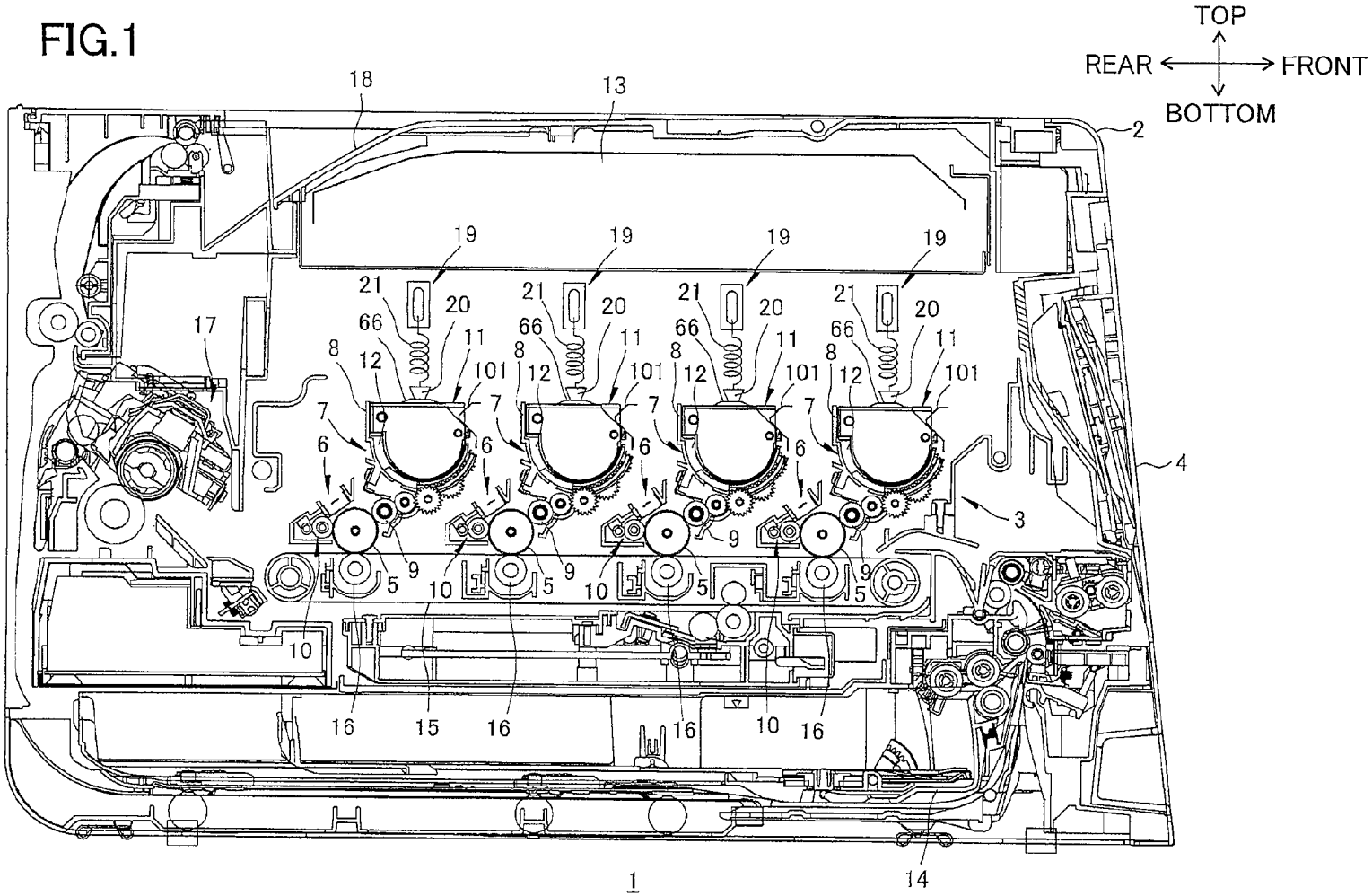
FIG. 1 is a cross-sectional view of a color printer according to one embodiment of the present invention.
Figure 2:
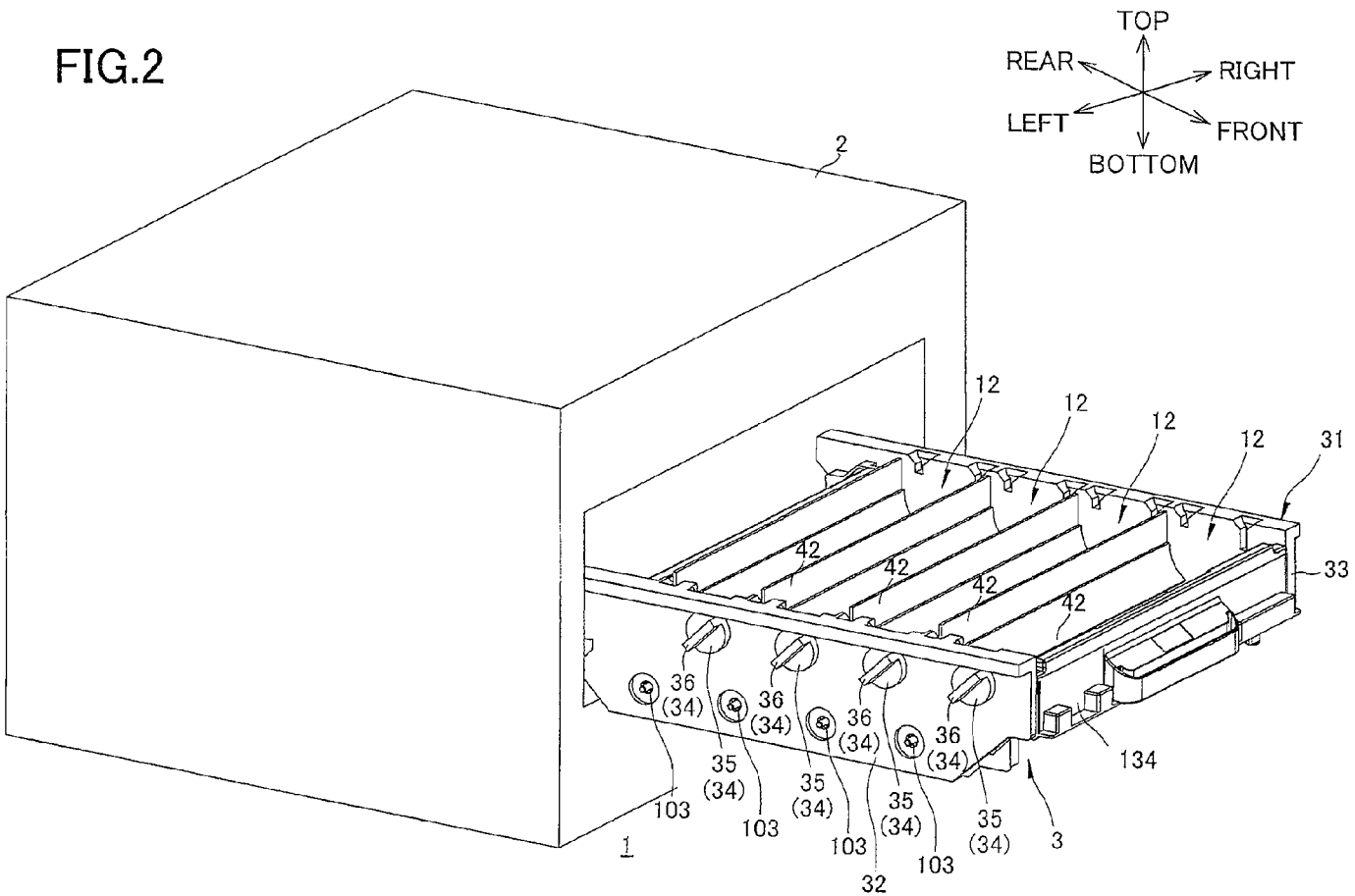
FIG. 2 is a perspective view of the color printer shown in FIG. 1, showing a drawer unit that has been pulled outward from a main casing of the color printer.

As shown in FIG. 1, the image forming device according to the embodiment is a tandem-type color printer 1. As shown in FIGS. 1 and 2, the color printer 1 includes a main casing 2. A drawer unit 3 as a process unit is mounted inside the main casing 2. The main casing 2 has a front portion at which a front cover 4 is provided. The front cover 4 is movable between an open position and a closed position. When the front cover 4 is in the open position, the drawer unit 3 can be moved horizontally between an accommodated position inside the main casing 2 (a position shown in FIG. 1) and a pulled-out position outside the main casing 2 (a position shown in FIG. 2).

The terms "upward", "downward", "upper", "lower", "above", "below", "right", "left", "front", "rear" and the like will be used throughout the description assuming that the color printer 1 is disposed in an orientation in which it is intended to be used. In the following description, a side of the color printer 1 on which the front cover 4 is provided (right side in FIG. 1) will be referred to as a front side of the color printer 1. Top, bottom, left, and right sides of the color printer 1 in the following description will be based on the reference point of a user viewing the color printer 1 from the front side. Directions related to the drawer unit 3 and a toner cartridge 11, described later, that is mounted in the drawer unit 3 will be referenced based on their positions when mounted in the main casing 2, unless otherwise specified. Note that the front cover 4 has been omitted from FIG. 2.

The drawer unit 3 includes a drawer frame 31 installing four photosensitive drums 5, four chargers 6, four developing units 7, and four cleaners 10.

As shown in FIG. 1, the four photosensitive drums 5 are rotatably retained in the drawer unit 3. The photosensitive drums 5 are capable of rotating about axes extending in a left-to-right direction. The four photosensitive drums 5 are respectively provided for the colors black, yellow, magenta, and cyan. The photosensitive drums 5 are arranged parallel to each other at regular intervals in a front-to-rear direction in the order black, yellow, magenta, and cyan from the front.

The four chargers 6 are also retained in the drawer unit 3. The chargers 6 have a one-on-one correspondence to the four photosensitive drums 5 and are disposed diagonally upward and rearward of the corresponding photosensitive drums 5. Each charger 6 is a Scorotron charger that includes a discharge wire and a grid, for example.

The four developing units 7 are also retained in the drawer unit 3. The four developing units 7 also have a one-on-one correspondence to the four photosensitive drums 5, and are disposed diagonally above and forward of the corresponding photosensitive drums 5. Each developing unit 7 includes a developing unit frame 8, and a developing roller 9 accommodated in the developing unit frame 8. Each developing roller 9 is disposed so as to contact the corresponding photosensitive drum 5 and is capable of rotating about an axis extending in the left-to-right direction.

The four cleaners 10 are also retained in the drawer unit 3. The four cleaners 10 also have a one-on-one correspondence to the four photosensitive drums 5 and are disposed rearward of the corresponding photosensitive drums 5. The cleaners 10 function to remove paper dust deposited on surfaces of the photosensitive drums 5.

A space 12 is defined in the drawer unit 3 above each developing unit 7. The toner cartridge 11 is mounted in the space 12. Sufficient free space above the drawer unit 3 is acquired for mounting the toner cartridges 11 in the spaces 12 by pulling the drawer unit 3 outward to the pulled-out position. The toner cartridges 11 supply toner to the corresponding developing units 7.

An exposure unit 13 is provided in the main casing 2 above the drawer unit 3. The exposure unit 13 irradiates four laser beams corresponding to the four colors used by the color printer 1.

As each photosensitive drum 5 rotates, the corresponding charger 6 applies a uniform charge to the surface of the photosensitive drum 5. Subsequently, the exposure unit 13 irradiates laser beams for selectively exposing the surfaces of the photosensitive drums 5. This exposure selectively removes charge from the surfaces of the photosensitive drums 5, forming electrostatic latent images thereon. When the electrostatic latent image carried on the surface of the photosensitive drum 5 rotates to a position opposite the corresponding developing roller 9, the developing roller 9 supplies toner to the electrostatic latent image, thereby forming a toner image on the surface of the photosensitive drum 5.

Four LED arrays may be provided for the four photosensitive drums 5 in place of the exposure unit 13.

A sheet cassette 14 accommodating sheets of paper P is disposed at a bottom section of the main casing 2. Each sheet P accommodated in the sheet cassette 14 is conveyed onto a conveying belt 15 by various rollers. The conveying belt 15 confronts the four photosensitive drums 5 from below. Four transfer rollers 16 are disposed inside the conveying belt 15 at positions confronting the photosensitive drums 5 through an upper portion of the conveying belt 15. When the sheet P is conveyed onto the conveying belt 15, the conveying belt 15 carries the sheet P sequentially through positions between the conveying belt 15 and each of the photosensitive drums 5. As the sheet P passes beneath each photosensitive drum 5, the toner image carried on the surface of the photosensitive drum 5 is transferred onto the sheet P.

A fixing unit 17 is provided at a position downstream of the conveying belt 15 with respect to a direction that the sheet P is conveyed. After toner images are transferred onto the sheet P, the sheet P is conveyed to the fixing unit 17, where the toner images are fixed to the sheet P by heat and pressure. After the toner images have been fixed in the fixing unit 17, various rollers discharge the sheet P onto a discharge tray 18 provided on a top surface of the main casing 2.

Four main casing pressure mechanisms 19 are provided in the main casing 2 so as to be disposed below the exposure unit 13 and above the drawer unit 3 accommodated in the main casing 2. The main casing pressure mechanisms 19 have a one-on-one correspondence to the four toner cartridges 11. Each of the main casing pressure mechanisms 19 includes two sets of a main casing pressure member 20 and an urging member 21. The urging member 21 is for urging the main casing pressure member 20 downward. Each set of the main casing pressure member 20 and the urging member 21 is movable between a lower position and an upper position. In the lower position, each main casing pressure member 20 contacts a pressed portion 66 (described later) provided at an upper surface of the toner cartridge 11 to press the pressed portion 66. In the upper position, the main casing pressure member 20 is separated upward from the drawer unit 3.

2. Drawer Unit (1) Drawer Frame

Figure 3:
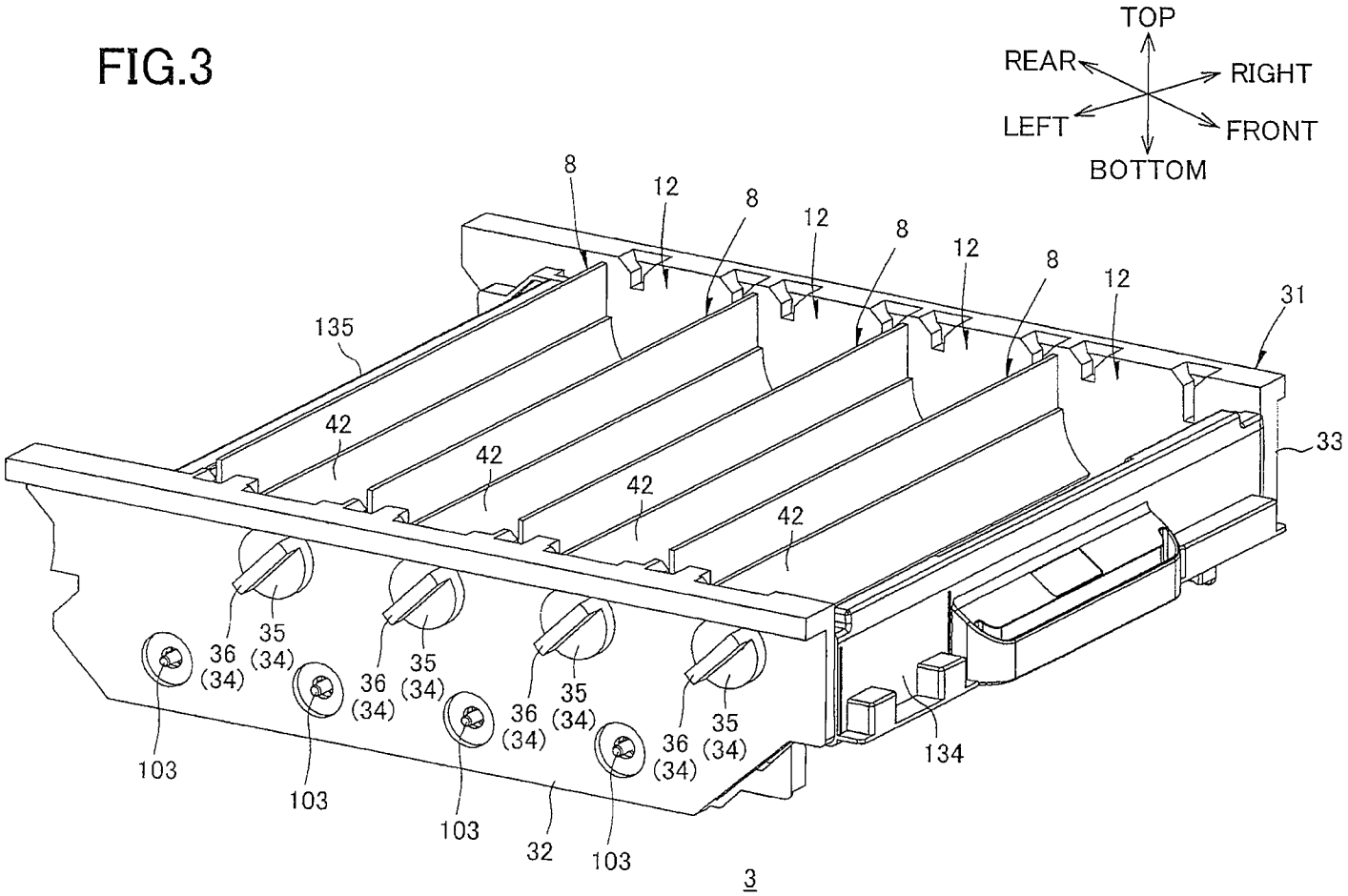
FIG. 3 is a perspective view of the drawer unit shown in FIG. 1, from which all toner cartridges are removed.

As shown in FIG. 3, the drawer unit 3 has the drawer frame 31. The drawer frame 31 is configured of a pair of side plates 32 and 33 arranged parallel to each other and separated in the left-to-right direction, a front beam 134 bridging the front ends of the side plates 32 and 33, and a rear beam 135 bridging the rear ends of the side plates 32 and 33. The overall structure of the drawer frame 31 is square-shaped in a plan view.

The respective groups of four photosensitive drums 5, chargers 6, developing units 7 and cleaners 10 (see FIG. 1) are all held together between the side plates 32 and 33 on the left and right sides thereof. The spaces 12 in which the toner cartridges 11 are mounted are defined between the side plates 32 and 33 above the corresponding developing units 7. In other words, the side plates 32 and 33 hold the photosensitive drums 5, the chargers 6, the developing units 7, and the cleaners 10. Further, the side plates 32 and 33 oppose each other in the left-to-right direction, with gaps formed therebetween to allocate the spaces 12 in which the toner cartridges 11 are mounted.

(2) Operation Guide Unit

Four operation guide units 34 are provided at the left side plate 32 at positions corresponding to the four spaces 12.

Figure 4:
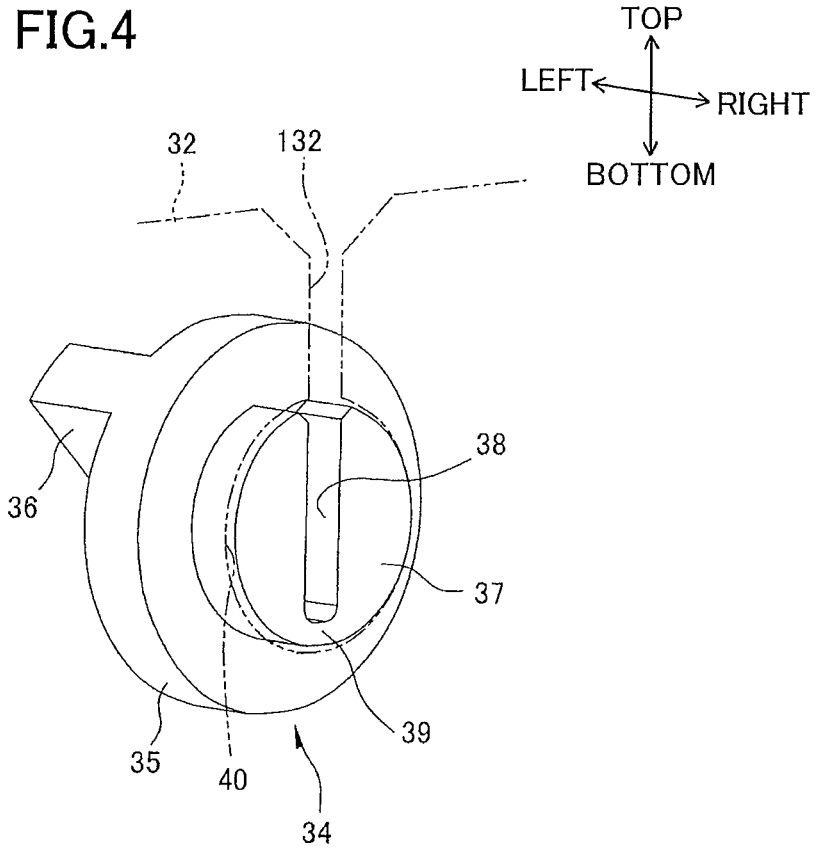
FIG. 4 is a perspective view of an operation guide unit shown in FIG. 3.

As shown in FIGS. 3 and 4, each operation guide unit 34 includes a disk-shaped main portion 35, an operation portion 36 and a guide portion 37. The main portion 35, the operation portion 36, and the guide portion 37 are integrally formed. The operation portion 36 is a protrusion protruding leftward from a left (outer) surface of the main portion 35. The guide portion 37 is provided on a right (inner) surface of the main portion 35. The guide portion 37 is formed in a disk-shape concentric with the main portion 35, having a diameter smaller than that of the main portion 35.

The guide portion 37 is formed with a guide groove 38. The guide portion 37 has a circumferential surface, from which the guide groove 38 extends along the diameter of the guide portion 37. The guide groove 38 does not penetrate the guide portion 37 in a diametrical direction of the guide portion 37. That is, the guide groove 38 has end portions in the diametrical direction, one of the end portions is open and remaining one of the end portions is closed. With this configuration, the operation guide unit 34 has an opposing portion 39 positioned between the circumferential surface of the guide portion 37 and the guide groove 38 in the diametrical direction. The opposing portion 39 functions as a positioning and retaining portion for guided portions 64 (described later) provided in the toner cartridge 11.

As indicated by an imaginary line shown in FIG. 4, the left side plate 32 has an upper portion formed with four circular fitting portions 40 at positions corresponding to the four spaces 12. Each fitting portion 40 has a diameter slightly greater than that of the guide portion 37. The guide portion 37 is rotatably fitted into the fitting portion 40, thereby rotatably holding the operation guide unit 34 in the left side plate 32. When the operation guide unit 34 is held in the left side plate 32, the operation portion 36 is positioned at a left side of the left side plate 32, and the guide portion 37 is positioned at a right side of the left side plate 32. The operation guide unit 34 is angularly movable between a first posture and a second posture, as described later.

Further, as indicated by the imaginary line shown in FIG. 4, an inner surface (right side surface) of the left side plate 32 is formed with four installation grooves 132. The installation groove 132 functions to accurately install the guided portions 64 of the toner cartridge 11 in the guide groove 38. Each installation groove 132 extends upward from an upper edge of the corresponding fitting portion 40. The installation groove 132 has a lower end portion having a width the same as that of the guide groove 38. The installation groove 132 has a width gradually increasing toward the top of the left side plate 32. With this configuration, the installation groove 132 is formed in a Y-shape as viewed from a right side.

(3) Developing Unit Frame

As shown in FIG. 3, the four developing unit frames 8 are disposed at regular intervals in the front-to-rear direction and span between the side plates 32 and 33. The developing unit frames 8 define the spaces 12 provided for mounting the toner cartridges 11.

Figure 5:
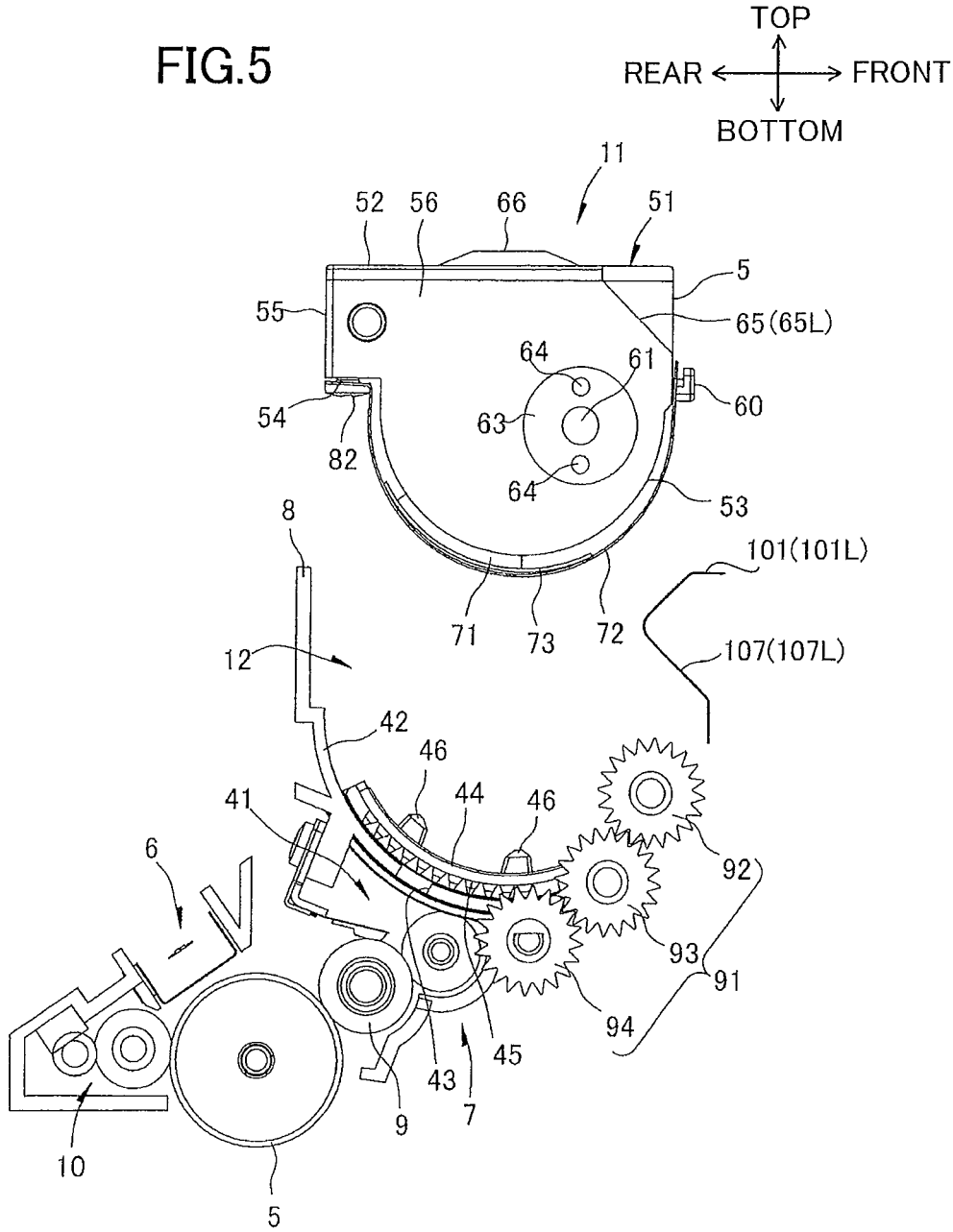
FIG. 5 is a partial cross-sectional view of the drawer unit shown in FIG. 3 and a left side view of the toner cartridge.

As shown in FIG. 5, a developing chamber 41 is formed in each developing unit frame 8 for accommodating the developing roller 9. The developing chamber 41 has a lower open side opposing the corresponding photosensitive drum 5. The developing roller 9 is disposed in the bottom of the developing chamber 41 near the open side thereof. Further, the developing roller 9 contacts the corresponding photosensitive drum 5 so as to press the photosensitive drum 5 in downward and rearward (that is, in a second direction described later).

The developing unit frame 8 also has a plate-shaped partitioning wall 42 positioned between the developing chamber 41 and the space 12. The partitioning wall 42 curves in an arc shape with its convex side facing the developing chamber 41. The partitioning wall 42 partitions the interior of the developing unit frame 8 into the developing chamber 41 and the space 12 formed above the developing chamber 41. Three rectangular openings 43 are formed in a circumferential center of the partitioning wall 42. The openings 43 are formed at positions opposing three cartridge communication holes 58

(FIG. 7, described later) formed in the toner cartridge 11 when the toner cartridge 11 is mounted in the space 12.

(4) Shutter Drive Assembly

As shown in FIG. 5, a shutter drive assembly 44 is movably disposed above the partitioning wall 42 for driving a shutter 73 described later.

The shutter drive assembly 44 is formed into an arcuate plate shaped, with the convex side facing the developing chamber 41. The arcuate shape of the shutter drive assembly 44 substantially conforms to the shape of the partitioning wall 42. The shutter drive assembly 44 has a bottom surface provided with a rack gear 45. The shutter drive assembly 44 has a top surface provided with shutter drive protrusions 46 at positions corresponding to shutter drive openings 88 (FIG. 7) described later.

3. Toner Cartridge (1) Casing

Figure 6:
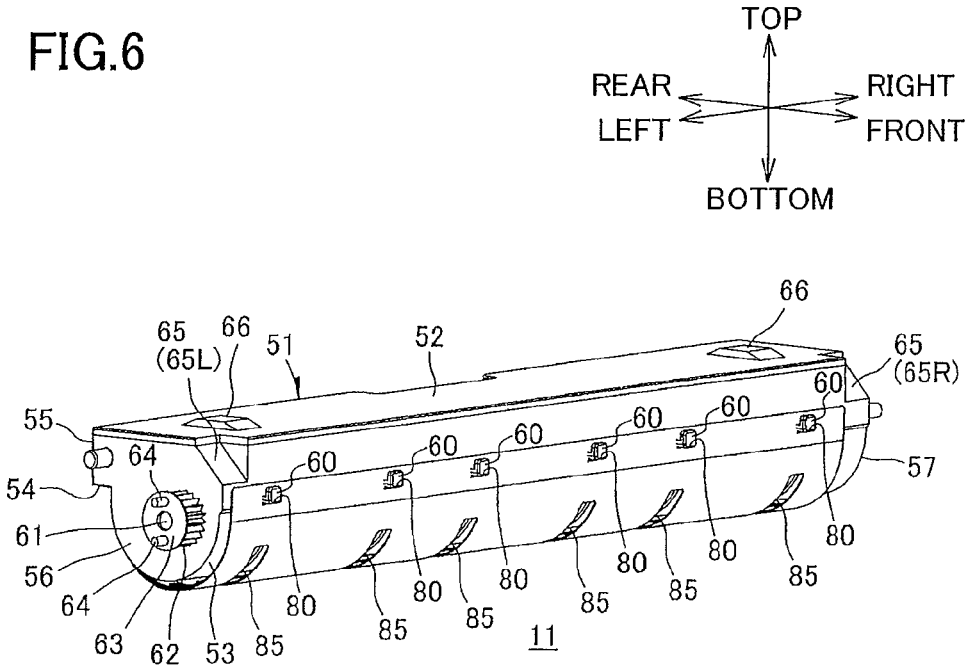
FIG. 6 is a perspective view of the toner cartridge shown in FIG. 5.
Figure 7:
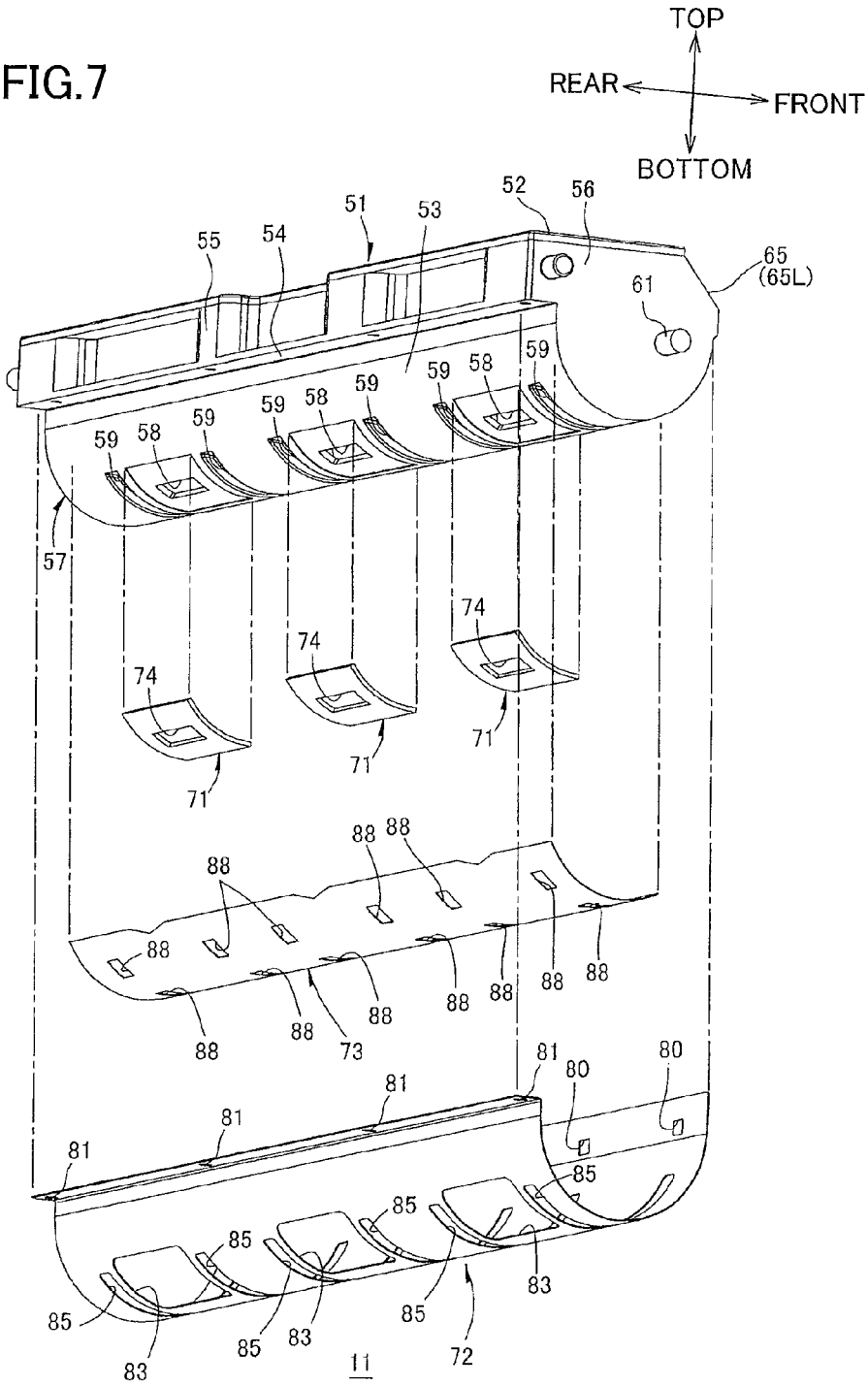
FIG. 7 is an exploded perspective view of the toner cartridge shown in FIG. 6.

As shown in FIGS. 6 and 7, the toner cartridge 11 includes a casing 51 for accommodating toner. The casing 51 is formed of resin in a substantially hollow semicircular column shape and is elongated in the left-to-right direction. More specifically, the casing 51 defines an internal space for accommodating toner, and includes a rectangular top surface 52, an arcuate surface 53, a fixing surface 54, a rear surface 55, a left side surface 56, and a right side surface 57.

The top surface 52 is elongated in the left-to-right direction. The arcuate surface 53 is connected to a front edge of the top surface 52 and has a substantially semicircular shape in a cross-section with a convex side facing downward. The fixing surface 54 extends parallel to the top surface 52 and protrudes rearward from a rear edge of the arcuate surface 53. The rear surface 55 bridges a rear edge of the top surface 52 and a rear edge of the fixing surface 54. The left side surface 56 bridges respective left edges of the top surface 52, the arcuate surface 53, the fixing surface 54 and the rear surface 55. The right side surface 57 bridges respective right edges of the top surface 52, the arcuate surface 53, the fixing surface 54, and the rear surface 55.

As shown in FIG. 7, the arcuate surface 53 is formed with the three cartridge communication holes 58 at positions slightly rearward of a lowest end thereof. The cartridge communication holes 58 are rectangular in shape and elongated in the left-to-right direction and are spaced at intervals in the left-to-right direction. The cartridge communication holes 58 provide communication between the interior and exterior of the casing 51.

Further, the arcuate surface 53 is formed with narrow slit-shaped relief grooves 59. The relief grooves 59 extend in a circumferential direction of the arcuate surface 53 and are formed one on each of left and right sides of each cartridge communication hole 58.

As shown in FIG. 6, the arcuate surface 53 has a front edge on which a plurality of positioning protrusions 60 is formed. The positioning protrusions 60 are spaced at intervals in the left-to-right direction. Each positioning protrusion 60 has a hook shape, extending forward, then bending and extending upward (see also FIG. 5).

As shown in FIGS. 6 and 7, the left side surface 56 is formed with a boss 61 protruding leftward therefrom. The boss 61 is formed in a columnar shape. As shown in FIG. 6, a drive force generation gear 62 is rotatably supported to the boss 61. The drive force generation gear 62 has a left side surface on which a disk plate 63 is fixedly provided. The disk plate 63 is provided with the two guided portions 64. The two guided portions 64 are provided at positions in confrontation with each other, interposing the boss 61 therebetween. That is, the two guided portions 64 are spaced apart from each other at an angle of 180 degrees about the boss 61. Each of the guided portions 64 has a columnar shape, and protrudes leftward from the disk plate 63.

Note that the drive force generation gear 62, the disk plate 63, and the guided portion 64 have been omitted from FIG. 7.

Further, as shown in FIG. 6, a triangle portion as viewed from a left side is cut-out from a corner defined by the top surface 52, the arcuate surface 53, and the left side surface 56, thereby forming a slant surface 65 (65L) extending diagonally above and rearward from the arcuate surface 53 to the top surface 52. In the same manner, a triangle portion as viewed from a right side is cut-out from a corner defined by the top surface 52, the arcuate surface 53, and the right side surface 57, thereby forming a slant surface 65 (65R) extending diagonally above and rearward from the arcuate surface 53 to the top surface 52.

Further, the top surface 52 of the casing 51 has left and right end portions at which the pressed portions 66 are provided, as shown in FIG. 6. That is, two pressed portions 66 are provided at the top surface 52; one of the pressed portions 66 is provided at the left end portion of the top surface 52, and remaining one of the pressed portions 66 is provided at the right end portion of the top surface 52. Each of the pressed portions 66 is formed in a square-frustum shape. The top surface 52 and the pressed portions 66 are integrally formed.

As shown in FIG. 7, the toner cartridge 11 further includes toner seals 71 affixed to the arcuate surface 53 of the casing 51, a shutter cover 72 disposed so as to cover the arcuate surface 53, and the shutter 73 disposed between the arcuate surface 53 and the shutter cover 72.

(2) Toner Seal

Figure 9A:
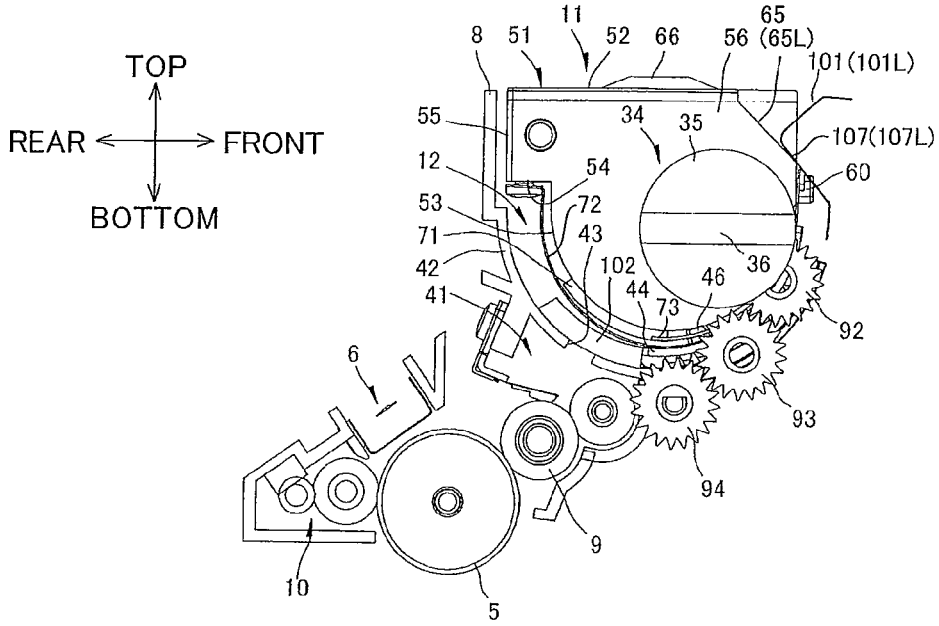
FIG. 9A is a schematic view of the operation guide unit along with a left side view of the toner cartridge shown in FIG. 5 and a partial cross-sectional view of the drawer unit shown in FIG. 5, wherein the toner cartridge is mounted in the drawer unit, the shutter is at an open position, and the toner cartridge is at a first position.

Each of the toner seals 71 is provided for each cartridge communication hole 58. The toner seal 71 has a sheet-like form and is formed with an opening 74 at a position corresponding to the cartridge communication hole 58. The toner seals 71 are fixed to the arcuate surface 53 of the casing 51 so that the openings 74 are aligned and in communication with the corresponding cartridge communication holes 58 and, hence, the toner seals 71 encircle the cartridge communication holes 58. Further, as shown in FIG. 9A, annular frame seals 102 are disposed on the partitioning wall 42 at positions confronting the corresponding toner seals 71 so as to surround the periphery of the corresponding openings 43. The frame seal 102 has an opening having a shape and dimension coincident with those of the opening 74 of the toner seal 71.

(3) Shutter Cover

The shutter cover 72 is curved to conform to the arcuate surface 53 of the casing 51. The shutter cover 72 is formed of a resin film. The shutter cover 72 has a width in the left-to-right direction substantially equal to a width of the arcuate surface 53 in the left-to-right direction. Thus, the shutter cover 72 covers the arcuate surface 53 across substantially the entire width in the left-to-right direction.

As shown in FIG. 7, the shutter cover 72 has a front end portion formed with a plurality of positioning openings 80 spaced apart from each other in the left-to-right direction. As shown in FIG. 6, the positioning protrusions 60 formed on the arcuate surface 53 of the casing 51 are engaged with the positioning openings 80. More specifically, the positioning openings 80 are formed in the front end portion of the shutter cover 72 and are arrayed in the left-to-right direction corresponding to the positioning protrusions 60. Further, the positioning openings 80 are formed of a sufficient size for inserting the positioning protrusions 60. After the positioning protrusions 60 are inserted into the corresponding positioning openings 80, top edges of the positioning openings 80 engage the positioning protrusions 60.

The shutter cover 72 has a rear end portion folded back to conform to the fixing surface 54 of the casing 51. A plurality of screw insertion through-holes 81 are formed in this rear end portion of the shutter cover 72 at intervals in the left-to-right direction, as shown in FIG. 7. As shown in FIGS. 5 and 6, the shutter cover 72 is attached to the casing 51 by engaging the positioning protrusions 60 with the respective positioning openings 80, and by inserting screws 82 through all of the screw insertion through-holes 81 and screwing tips of the screws 82 into the fixing surface 54 of the casing 51.

As shown in FIG. 7, the shutter cover 72 is formed with shutter cover communication holes 83 at positions corresponding to the toner seals 71. Each of the shutter cover communication holes 83 has a rectangular shape and is elongated in the left-to-right direction. Further, the shutter cover communication hole 83 has an open area greater than that of the cartridge communication hole 58 so as to expose the cartridge communication hole 58 in its entirety.

Further, the shutter cover 72 is formed with guide slits 85 elongated in the front-to-rear direction (circumferential direction of the shutter cover 72) at positions corresponding to the relief grooves 59 formed in the casing 51. The guide slit 85 has a front-to-rear length greater than or equal to that of the relief groove 59. The guide slits 85 also has a left-to-right width greater than or equal to that of the relief groove 59. Each guide slit 85 confronts the corresponding relief groove 59 in its entirety.

(4) Shutter

As shown in FIG. 7, the shutter 73 curves along the arcuate surface 53 of the casing 51. The shutter 73 is formed of a resin film having a width in the left-to-right direction slightly smaller than that of the shutter cover 72. The shutter 73 has a dimension along the circumferential direction of the arcuate surface 53 greater than that of the toner seal 71. Further, the dimension of the shutter 73 along the circumferential direction of the arcuate surface 53 is set such that the shutter 73 does not contact the fixing surface 54 and the positioning protrusions 60 when moving between an open position and a closed position described later.

The shutter 73 is formed with two shutter drive openings 88 separated by a prescribed interval in a circumferential direction of the shutter 73 at positions opposing each relief groove 59 in the casing 51. The distance between the two shutter drive openings 88 in the circumferential direction is set such that all shutter drive openings 88 confront the corresponding relief grooves 59 and confront and communicate with the corresponding guide slits 85 formed in the shutter cover 72, regardless of whether the shutter 73 is in the open position or the closed position.

The shutter 73 is interposed between the arcuate surface 53 of the casing 51 and the shutter cover 72. While held between the arcuate surface 53 and the shutter cover 72, the shutter 73 can move between the open position and the closed position.

When the shutter 73 is in the open position, a rear edge of the shutter 73 is interposed between a front edge portion of the toner seal 71 and the shutter cover 72. Therefore, each cartridge communication hole 58 formed in the casing 51 and the opening 74 formed in the corresponding toner seal 71 are made open, while being in communication between the cartridge communication holes 58 and the shutter cover communication holes 83. This provides communication between the interior and exterior of the casing 51.

On the other hand, in the closed position, the shutter 73 is positioned farther rearward than the open position. When the shutter 73 is in the closed position, the rear edge of the shutter 73 is positioned slightly rearward from rear edges of the shutter cover communication holes 83. As a result, the shutter 73 covers the cartridge communication holes 58 formed in the casing 51 and the openings 74 formed in the toner seals 71 in their entirety, blocking communication between the interior and exterior of the casing 51. At this time, the toner seals 71 are interposed between the shutter 73 and the arcuate surface 53 of the casing 51.

4. Drive Force Transmission Mechanism

Within the drawer frame 31, a plurality of drive force transmission mechanisms 91 each corresponding to each shutter drive assembly 44 is provided, as shown in FIG. 5. The drive force transmission mechanism 91 functions to transmit a drive force generated by the drive force generation gear 62 provided in the toner cartridge 11 to the rack gear 45 of the shutter drive assembly 44. Each drive force transmission mechanism 91 includes a first transmission gear 92, a second transmission gear 93, and a third transmission gear 94. When the toner cartridge 11 is in the space 12, the first transmission gear 92 is meshedly engageable with the drive force generation gear 62, the second transmission gear 93 is meshedly engageable with the first transmission gear 92, and the third transmission gear 94 is meshedly engageable with the second transmission gear 93 and the rack gear 45. The first to third transmission gears 92, 93, 94 are rotatably supported to the left side plate 32 of the drawer frame 31.

When the drive force generation gear 62 rotates, a rotational force is transmitted to the first transmission gear 92 from the drive force generation gear 62, thereby rotating the first transmission gear 92. The rotational force transmitted to the first transmission gear 92 is further transmitted to the rack gear 45 through the second transmission gear 93 and the third transmission gear 94. With this configuration, the shutter drive assembly 44 can move in the front-to-rear direction along the partitioning wall 42, and, as described later, the shutter 73 can move between the open position and the closed position in association with the movement of the shutter drive assembly 44. The drive force generation gear 62, the first transmission gear 92, the second transmission gear 93, the third transmission gear 94, and the rack gear 45 constitute a drive mechanism (gear train) for moving the shutter 73 between the open position and the closed position.

5. Drawer Unit Pressure Member

Further, a plurality of a pair of drawer unit pressure members 101 (a left drawer unit pressure member 101L, a right drawer unit pressure member 101R (not shown)) each corresponding to each toner cartridge 11 (space 12) is provided in the drawer frame 31, as shown in FIG. 5. The pair of the drawer unit pressure members 101 functions to press the toner cartridge 11 toward the corresponding developing units 7. The drawer unit pressure member 101 is formed of a wire spring. One of the pair of drawer unit pressure members 101L has a lower end portion that is supported to the left side plate 32 of the drawer frame 31, and remaining one of the pair of the drawer unit pressure members 101R has a lower end portion that is supported to the right side plate 33 of the drawer frame 31. In other words, the four drawer unit pressure members 101L are provided at the left side plate 32, and another four drawer unit pressure members 101R are provided at the right side plate 33. Each drawer unit pressure member 101 has a shape extending upward from the lower end portion, then bending diagonally above and rearward, and then folding diagonally above and forward. More specifically, the left drawer unit pressure member 101L has a portion 107 (107L) extending diagonally above and rearward, and the portion 107L is inclined relative to a horizontal plane at an angle the same as that of the slant surface 65 (65L) of the casing 51 of the toner cartridge 11. Likewise, the right drawer unit pressure member 101R has a portion 107 (107R, not shown)

extending diagonally above and rearward, and the portion 107R is inclined relative to a horizontal plane at an angle the same as that of the slant surface 65 (65R) of the casing 51 of the toner cartridge 11.

6. Mounting and Dismounting of Toner Cartridge (1) Mounting of Toner Cartridge

While the drawer unit 3 (drawer frame 31) is pulled outward from the main casing 2 and disposed at the pulled-out position (FIG. 2), the toner cartridge 11 is mounted in or dismounted from the space 12 from above. Note that mounting of the toner cartridge 11 in the space 12 implies attachment of the toner cartridge 11 relative to the developing unit 7.

Figure 8A:
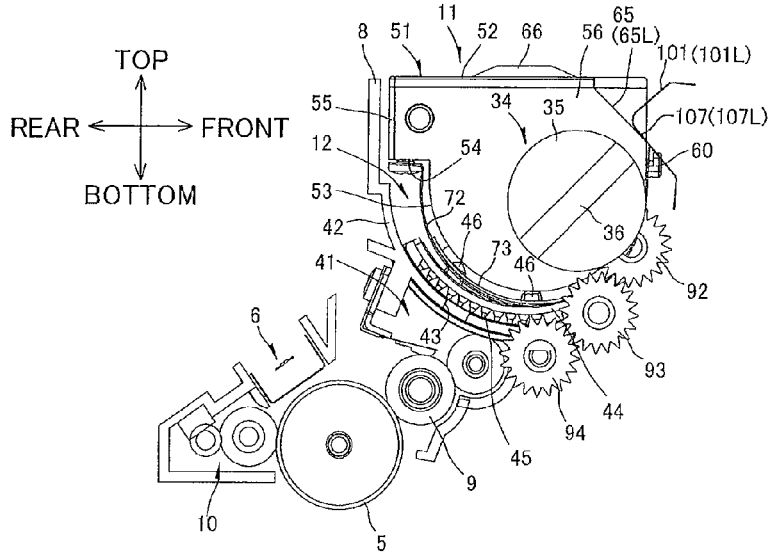
FIG. 8A is a schematic view of the operation guide unit along with a left side view of the toner cartridge shown in FIG. 5 and a partial cross-sectional view of the drawer unit shown in FIG. 5, wherein the toner cartridge is mounted in the drawer unit and a shutter of the toner cartridge is at a closed position.
Figure 8B:
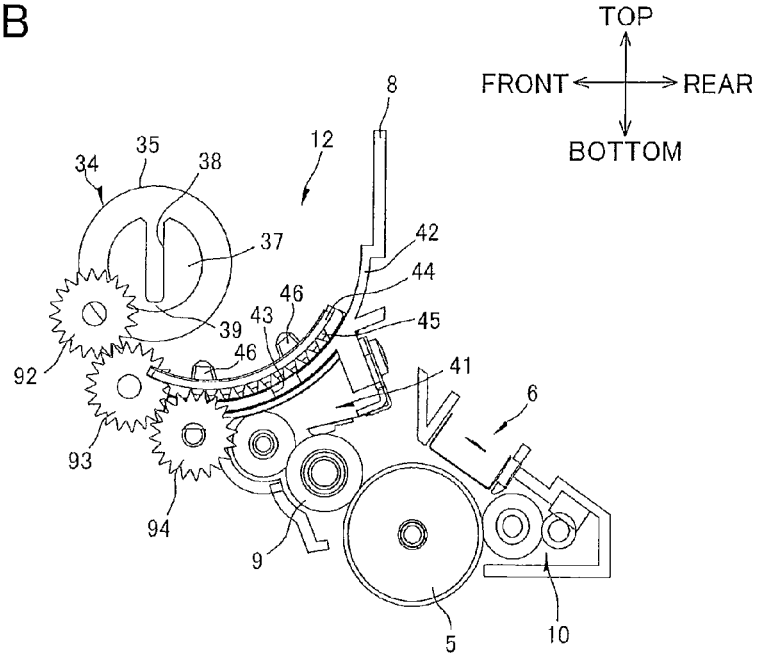
FIG. 8B is a partial cross-sectional view of the drawer unit at a state shown in FIG. 8A.

When the toner cartridge 11 is not mounted in the space 12, as shown in FIG. 8B, the operation guide unit 34 is in the first posture. When the operation guide unit 34 is in the first posture, the guide groove 38 extends in a first direction (an upper-to-lower direction) and the opposing portion 39 is disposed below the guide groove 38. As shown in FIG. 8A, when the operation guide unit 34 is in the first posture, the operation portion 36 extends diagonally above and forward from a lower rear side. At this time, the shutter drive protrusion 46 positioned closer to a front side among the pairs of shutter drive protrusions 46 formed in the shutter drive assembly 44 protrude upward along a substantially vertical direction, while the shutter drive protrusion 46 positioned closer to a rear side among the pairs of shutter drive protrusions 46 protrude in a direction angled upward and forward.

When the toner cartridge 11 is not mounted in the drawer unit 3, the shutter 73 is in the closed position. Further, as shown in FIG. 5, the two guided portions 64 are aligned in the first direction (upper-to-lower direction).

When the toner cartridge 11 is mounted in the space 12, the two guided portions 64 are inserted into the guide groove 38 from above through the installation groove 132 formed in the left side plate 32. Since the guide groove 38 extends in the first direction, the toner cartridge 11 moves in the first direction in association with movement of the guided portions 64 along the guide groove 38. Movement of the guided portions 64 is stopped by bringing the leading guided portion 64 into contact with the opposing portion 39. In other words, when the operation guide unit 34 is in the first posture, the opposing portion 39 serves as a positioning portion for determining the position of the leading guided portion 64 (the position of the toner cartridge 11).

Incidentally, it is not necessary for the two guided portions 64 to be accurately aligned in the first direction. The two guided portions 64 may be aligned in a direction slightly inclined relative to the first direction. Even if the guided portions 64 are inclined relative to the first direction, when the guided portions 64 are inserted into the installation groove 132 from above to be moved along the installation groove 132, slant surfaces formed in the upper end portion of the installation groove 132 guides the two guided portions 64 so as to be aligned in the first direction.

Movement of the toner cartridge 11 in the first direction brings the shutter drive protrusions 46 into engagement with the shutter drive openings 88 through the guide slits 85. Thus, the toner cartridge 11 is brought into contact with the shutter drive assembly 44. As a result, mounting of the toner cartridge 11 in the space 12 can be achieved. When the toner cartridge 11 is mounted in the space 12, the portions 107L, 107R are respectively brought into contact with the slant surfaces 65L, 65R, so that the toner cartridge 11 can be pressed downward and rearward by the pair of drawer unit pressure members 101L, 101R with a relatively small force.

Figure 9B:
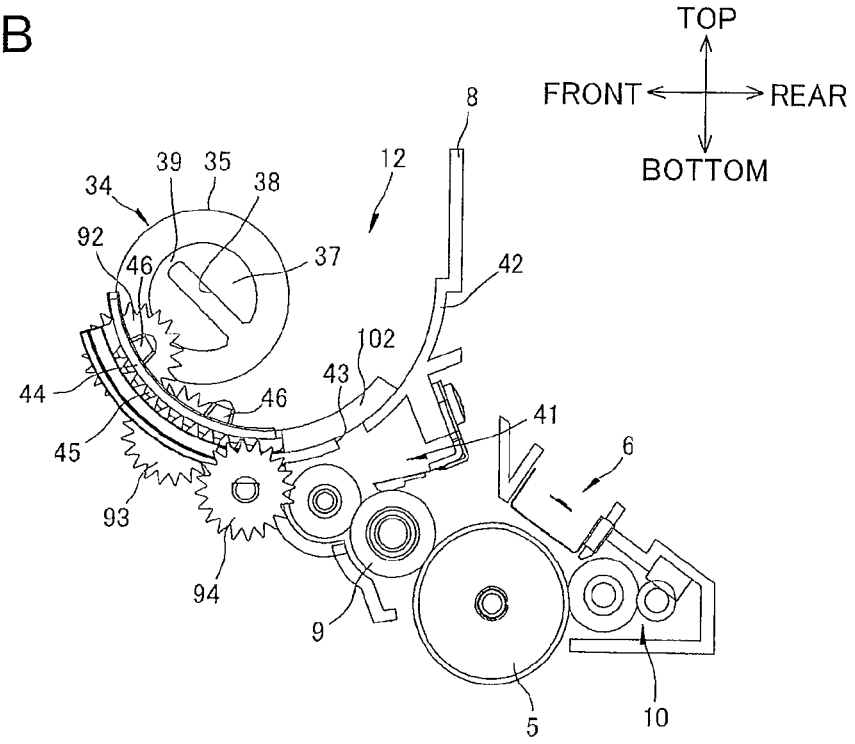
FIG. 9B is a partial cross-sectional view of the drawer unit at a state shown in FIG. 9A.

Subsequently, the operation guide unit 34 is shifted to the second posture from the first posture, as shown in FIGS. 9A and 9B. That is, a user holds the operation portion 36 by his/her fingers to angularly rotate the operation guide unit 34 in a counterclockwise direction as viewed from a left side at an angle of 135 degrees so that, as shown in FIG. 9A, the operation guide unit 34 is shifted to the second posture in which the operation portion 36 extends horizontally from the first posture in which the operation portion 36 is inclined and extends diagonally above and forward from the lower rear side.

In association with the shift of the operation guide unit 34 to the second posture from the first posture, the guide groove 38 extends in the second direction that inclines diagonally downward and rearward, as shown in FIG. 9B. Accordingly, a direction for guiding the guided portions 64 by the guide groove 38 is shifted to the second direction from the first direction. Further, in association with the angular rotation of the operation guide unit 34, the guided portions 64 are angularly moved about the boss 61. In association with the angular movement of the guided portions 64, the drive force generation gear 62 and the disk plate 63 rotate in the counterclockwise direction as viewed from the left side. Rotation of the drive force generation gear 62 generates a rotational force. The rotational force is transmitted to the third transmission gear 94 through the first transmission gear 92 and the second transmission gear 93, and thus, the third transmission gear 94 rotates in a clockwise direction as viewed from the left side. In association with the rotation of the third transmission gear 94, the shutter drive assembly 44 moves forward to a position forward of the openings 43 from a position opposing the openings 43. In association with the movement of the shutter drive assembly 44, the shutter 73 moves forward from the closed position along with the shutter drive assembly 44. The shutter 73 is then positioned at the open position.

When the operation guide unit 34 is in the second posture, the opposing portion 39 confronts the leading guided portion 64 at a position diagonally above and forward of the leading guided portion 64. Because of the position of the opposing portion 39, the guided portions 64 cannot be pulled out of the guide groove 38. That is, when the operation guide unit 34 is in the second posture, the opposing portion 39 serves as the retaining portion for retaining the guided portions 64 in the guide groove 38.

At this time, the toner cartridge 11 is positioned at a first position in which the toner cartridge 11 is located at a position relatively far from the partitioning wall 42. A slight gap is formed between the toner cartridge 11 and the frame seals 102. Further, the shutter cover 72 is not pressed against the toner seals 71. That is, the shutter cover 72 is not in contact with the toner seals 71.

Then, the drawer unit 3 is moved to the accommodated position inside the main casing 2 (FIG. 1). When the drawer unit 3 is located at the accommodated position, each set of the main casing pressure member 20 and the urging member 21 moves downward to the lower position from the upper position, each main casing pressure member 20 is brought into contact with the corresponding pressed portion 66 provided at the upper surface of the toner cartridge 11, and each pressed portion 66 is pressed downward by the corresponding main casing pressure member 20.

Figure 10:
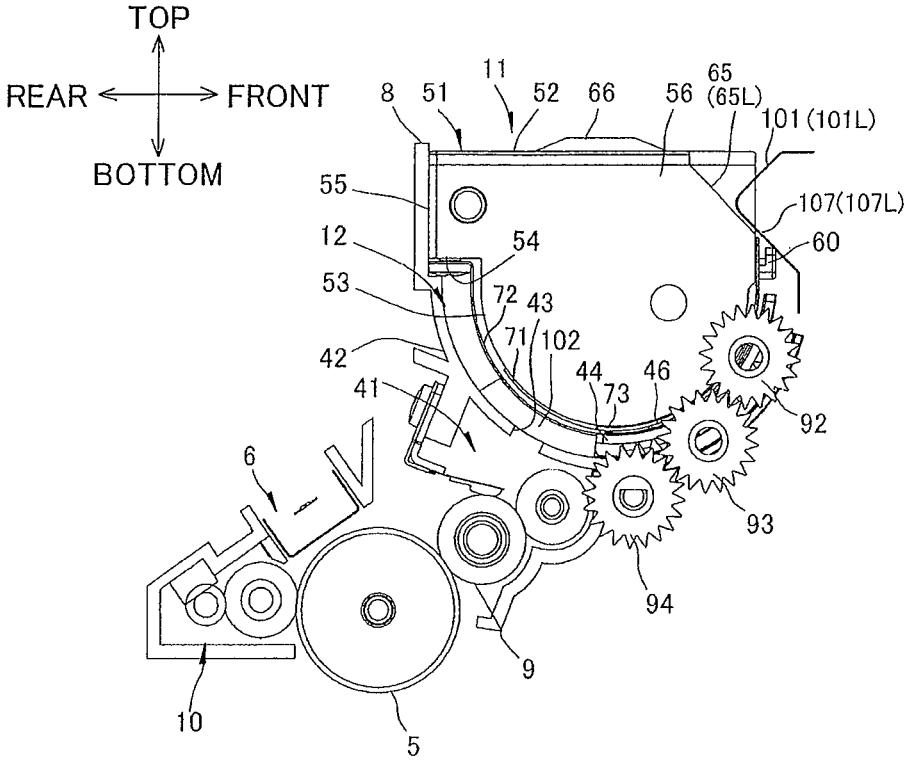
FIG. 10 is a left side view of the toner cartridge shown in FIG. 5 and a partial cross-sectional view of the drawer unit shown in FIG. 5, wherein the toner cartridge is mounted in the drawer unit, the shutter is at the open position, and the toner cartridge is at a second position.

Since the guide groove 38 is inclined in the second direction (FIG. 9B), a pressure force that the pressed portions 66 are pressed downward is converted to a force directed downward and rearward. Hence, the toner cartridge 11 moves downward and rearward, that is, moves in the second direction. With this movement, as shown in FIG. 10, the toner cartridge 11 is positioned at a second position in which the toner cartridge 11 is located at a position relatively close to the partitioning wall 42. Each of the toner seals 71 has a protruding portion that protrudes outward through the corresponding shutter cover communication hole 83. The protruding portions of the toner seals 71 are brought into pressure contact with the corresponding frame seals 102 from above and front, that is, from upstream of the frame seals 102 in the second direction. Hence, the toner seals 71 and the frame seals 102 are compressed. Therefore, while the toner seals 71 and the frame seals 102 seal any gaps formed between the partitioning wall 42 and the shutter cover 72, the openings 74 formed in the toner seals 71 are in communication with the corresponding openings 43 through the opening formed in the corresponding frame seals 102.

Thereafter, when the front cover 4 (FIG. 1) is moved to the closed position, an image forming operation can be started.

(2) Dismounting of Toner Cartridge

For dismounting the toner cartridge 11 from the drawer unit 3, the front cover 4 is moved to the open position, and the drawer unit 3 is moved from the accommodated position to the pulled-out position. Then, the operation guide unit 34 is shifted to the first posture from the second posture. That is, the operation guide unit 34 is angularly rotated in a clockwise direction as viewed from the left side at an angle of 135 degrees. In association with the angular rotation of the operation guide unit 34, the guide groove 38 extends in the first direction. By performing, in reverse order, the above described operation when the toner cartridge 11 is mounted in the space 12, the shutter 73 is moved to the closed position from the open position.

Subsequently, the toner cartridge 11 is removed upward from the space 12. Because the guide groove 38 extends in the first direction, the guided portions 64 are guided upward. When the toner cartridge 11 has been removed from the drawer unit 3, the shutter 73 is in the closed position. Accordingly, there is no risk of toner spilling out of the casing 51 when the toner cartridge 11 is removed.

7. Pressing and Releasing Developing Roller

Further, the color printer 1 has a mechanism for separating the developing rollers 9 from the corresponding photosensitive drums 5 when an image forming operation is not performed, in order to restrain degradation of the photosensitive drums 5 and the developing rollers 9.

As shown in FIG. 3, each of the developing rollers 9 is provided with a roller shaft 103. Each roller shaft 103 has end portions each protruding outward of the developing unit frame 8 and further protruding outward of the side plates 32, 33.

Figure 11:
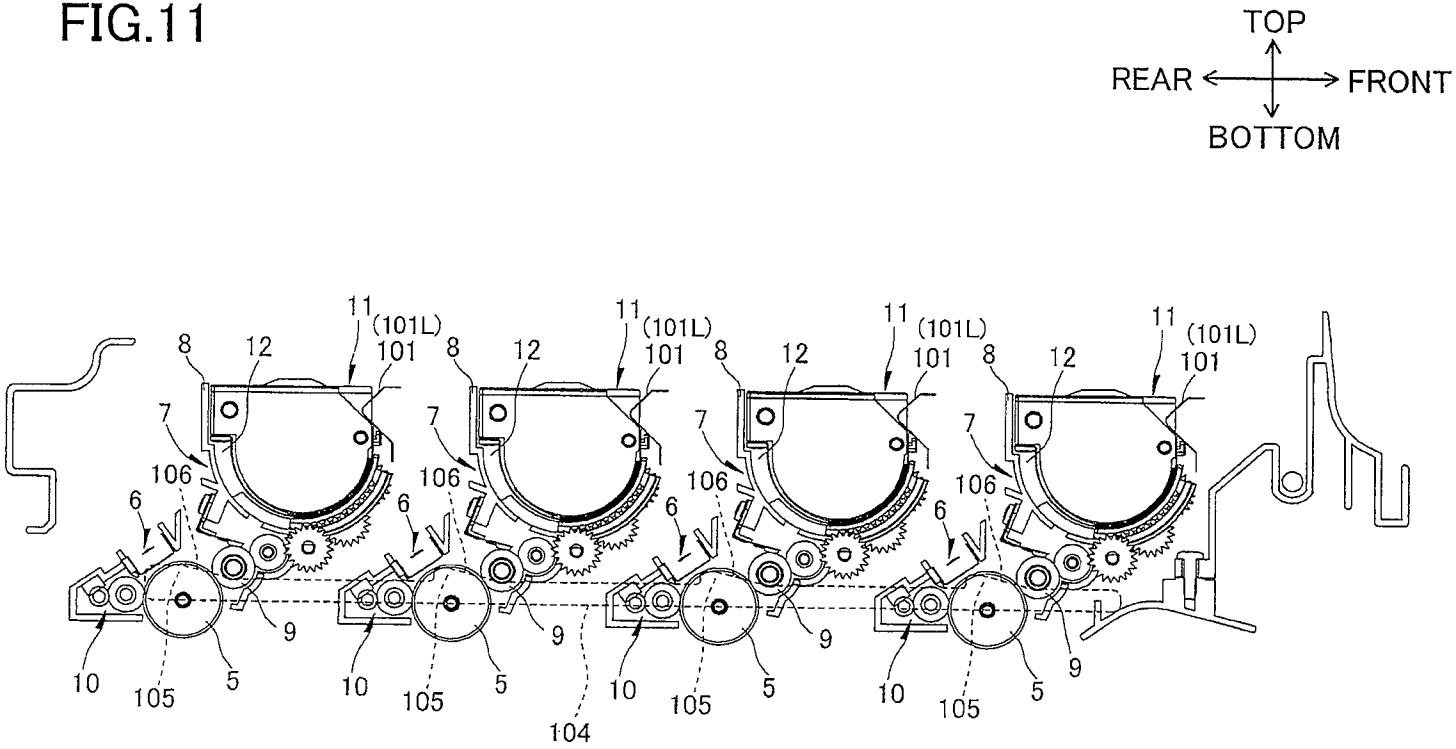
FIG. 11 is a cross-sectional view of the drawer unit shown in FIG. 1, showing a state that developing rollers are in contact with photosensitive drums, respectively.
Figure 12:
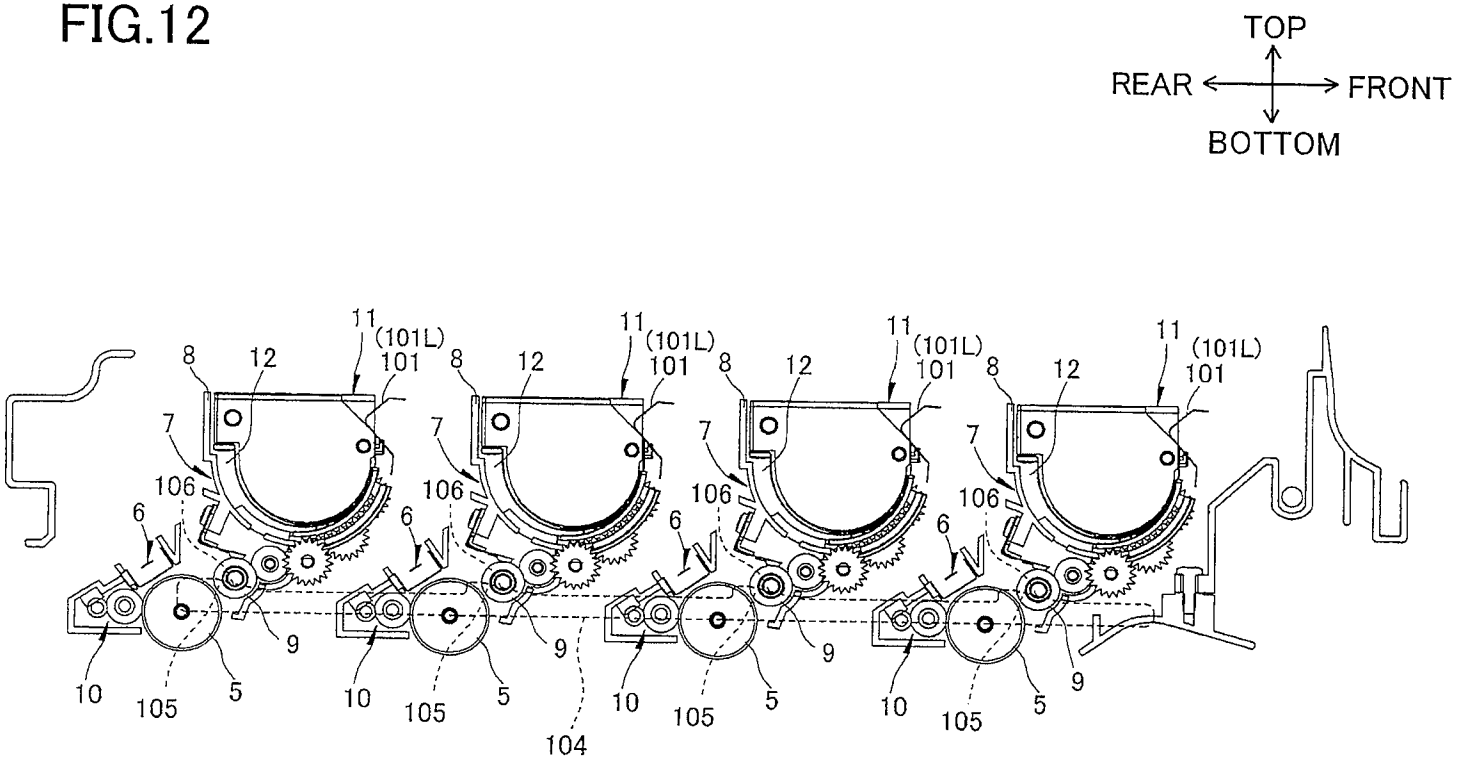
FIG. 12 is a cross-sectional view of the drawer unit shown in FIG. 1, showing a state that the developing rollers are separated from the respective photosensitive drums.

As shown in FIGS. 11 and 12, within the main casing 2, two separation cams 104 are provided at positions confronting outer surfaces of the side plates 32, 33, respectively, when the drawer unit 3 is in the accommodated position. Each of the separation cams 104 is formed in a plate shape and extends in the front-to-rear direction. The separation cams 104 are linearly movable in the front-to-rear direction. The separation cams 104 confront the end portions of the roller shafts 103 protruding from the side plates 32, 33 from below. Further, each of the separation cams 104 has an upper surface having four separating portions 105. Each separating portion 105 is formed in a trapezoidal-shape as viewed from a left (right) side. The four separating portions 105 are arranged at intervals in the front-to-rear direction. Each of the separating portions 105 has a slant surface 106 extending diagonally above and rearward from each front portion of each separating portion 105.

When the developing roller 9 is in contact with the photosensitive drum 5, as shown in FIG. 11, each separating portion 105 of each separation cam 104 is disposed rearward of the corresponding roller shaft 103. Further, end portions of each roller shaft 103 contact from above portions of the corresponding separation cams 104, the portions being positioned forward of the corresponding separating portions 105. In this state, when the separation cams 104 move forward, the slant surfaces 106 are brought into contact with the end portions of the corresponding roller shafts 103. When the separation cams 104 further move forward, as shown in FIG. 12, the end portions of each roller shaft 103 move onto the corresponding slant surfaces 106. As a result, each roller shaft 103 is pressed upward and forward by the corresponding slant surfaces 106. Hence, each of the developing rollers 9 moves upward and forward, and is separated from the corresponding photosensitive drum 5.

When the separation cams 104 move rearward while the developing rollers 9 are spaced apart from the corresponding photosensitive drums 5, the slant surface 106 of each separating portion 105 moves rearward of the end portion of the corresponding roller shaft 103, and separates therefrom. As described above, the toner cartridge 11 (toner seals 71) has been pressed relative to the developing unit frame 8 (frame seals 102) from above and front, that is, from upstream of the shutter cover communication holes 83 in the second direction. Therefore, when pressure of the roller shaft 103 by the slant surfaces 106 is released, the developing roller 9 moves in the second direction. As a result, the developing roller 9 is brought into contact with the corresponding photosensitive drum 5 in the second direction.

8. Operations and Effects (1) Operation and Effect 1

As described above, the toner cartridge 11 includes the casing 51 and the pressed portions 66. Movement of the casing 51 in the first direction (upper-to-lower direction) allows the casing 51 to be mounted in or dismounted from the developing unit 7. Further, the pressed portions 66 are pressed by the main casing pressure members 20, so that the toner cartridge 11 is pressed relative to the developing unit 7 in the second direction different from the first direction (that is, in a direction that inclines diagonally below and rearward).

In order to guide movement of the toner cartridge 11 in the first direction and the second direction, the operation guide unit 34 (the guide portion 37) is provided on the left side plate 32 of the drawer frame 31. The operation guide unit 34 (the guide portion 37) can be shifted between the first posture and the second posture. Further, the operation guide unit 34 includes the operation portion 36 that is operated to shift the operation guide unit 34 between the first posture and the second posture. The operation guide unit 34 in the first posture guides movement of the toner cartridge 11 in the first direction, while the operation guide unit 34 in the second posture guides movement of the toner cartridge 11 in the second direction.

The operation portion 36 is operated to selectively shift the posture of the operation guide unit 34 either in the first posture or in the second posture, thereby allowing the toner cartridge 11 to selectively move either in the first direction or in the second direction. The first posture of the operation guide unit 34 reliably guides the toner cartridge 11 to move in the first direction, and the second posture of the operation guide unit 34 reliably guides the toner cartridge 11 to move in the second direction.

(2) Operation and Effect 2

The casing 51 of the toner cartridge 11 is formed with cartridge communication holes 58 for supplying toner accommodated inside the casing 51 to the developing unit 7. Further, the toner cartridge 11 includes the shutter 73 movable between the open position in which the cartridge communication holes 58 are open and the closed position in which the cartridge communication holes 58 are closed.

Further, in order to move the shutter 73 between the open position and the closed position, the drive mechanism (gear train) including the drive force generation gear 62, the first transmission gear 92, the second transmission gear 93, the third transmission gear 94, and the rack gear 45 is provided. With this drive mechanism, when the operation portion 36 is operated to shift the operation guide unit 34 from the first posture to the second posture, the shutter 73 is moved to the open position from the closed position. When the operation portion 36 is operated to shift the operation guide unit 34 from the second posture to the first posture, the shutter 73 is moved to the closed position from the open position.

Accordingly, in association with the operation of the operation portion 36, the operation guide unit 34 can be shifted between the first posture and the second posture, and the shutter 73 can be moved between the open position and the second position.

(3) Operation and Effect 3

The periphery of the cartridge communication hole 58 is surrounded by the toner seal 71. When the shutter 73 is in the closed position, the toner seals 71 are interposed between the casing 51 and the shutter 73. Therefore, when the shutter 73 is in the closed position, toner leakage to a portion between the casing 51 and the shutter 73 through the cartridge communication holes 58 can be prevented.

Even if the toner seals 71 are interposed between the casing 51 and the shutter 73, while the operation guide unit 34 is in the first posture, the toner cartridge 11 is not pressed in the second direction. Hence, the casing 51 and the shutter 73 are not excessively in pressure contact with the toner seals 71. In addition, the shutter 73 does not pressingly contact the frame seals 102. Therefore, when the operation guide unit 34 is shifted to the second posture from the first posture and the shutter 73 moves to the open position from the closed position, the operation portion 36 can be operated with a relatively small force.

(4) Operation and Effect 4

A plurality of the main casing pressure members 20 is provided within the main casing 2. When the drawer unit 3 is accommodated in the main casing 2, each main casing pressure member 20 presses the corresponding toner cartridge 11 toward the corresponding developing unit 7. Prior to accommodating the drawer unit 3 in the main casing 2, the operation guide unit 34 has been shifted to the second posture from the first posture. Hence, when the main casing pressure member 20 presses the toner cartridge 11, the toner cartridge 11 is pressed toward the corresponding developing unit 7 in the second direction. As a result, the toner seals 71 are brought into pressure contact with the corresponding frame seals 102. Hence, while the toner seals 71 and the frame seals 102 seal any gaps formed between the developing unit 7 and the corresponding toner cartridge 11, the interior of the casing 51 of the toner cartridge 11 is in communication with the interior of the developing chamber 41 through the cartridge communication holes 58.

Only when the drawer unit 3 is accommodated in the main casing 2, each main casing pressure member 20 presses the corresponding toner cartridge 11. Accordingly, pressure of the toner cartridge 11 by the main casing pressure member 20 does not inhibit the operation guide unit 34 from shifting between the first posture and the second posture or the shutter 73 from moving between the open position and the closed position. In other words, when the drawer unit 3 is pulled outward from the main casing 2, the toner cartridge 11 is not pressed by the main casing pressure member 20. Thus, a force applied to the operation portion 36 when moving the operation guide unit 34 and the shutter 73 can be relatively small. As a result, excellent operability of the operation portion 36 can be further achieved.

(5) Operation and Effect 5

The drive force generation gear 62, the first transmission gear 92, the second transmission gear 93, the third transmission gear 94 and the rack gear 45 constitute the drive mechanism (gear train) for moving the shutter 73 between the open position and the closed position. With this gear train, a force inputted into the operation portion 36 by its operation can be reliably transmitted to the shutter 73. Hence, the shutter 73 can be reliably moved between the open position and the closed position.

(6) Operation and Effect 6

The toner cartridge 11 includes the guided portions 64 that are guided by the operation guide unit 34. The guided portions 64 are fixed to the drive force generation gear 62. In association with the shift of the operation guide unit 34 between the first posture and the second posture, the guided portions 64 are angularly moved so as to rotate the drive force generation gear 62. Rotation of the drive force generation gear 62 generates a drive force to move the shutter 73. That is, because the drive force generation gear 62 is integral with the guided portions 64, a part of a force applied to the operation portion 36 to shift the operation guide unit 34 between the first posture and the second posture can be employed as a drive force to move the shutter 73. Therefore, there is no need to provide a drive source (such as a motor) for generating a drive force for moving the shutter 73 independently from generating a force applied to the operation portion 36. Accordingly, the structure of the color printer 1 can be simplified.

(7) Operation and Effect 7

The operation guide unit 34 rotates in association with operation of the operation portion 36, so that the operation guide unit 34 can be shifted between the first posture and the second posture. Therefore, compared with a structure that the operation guide unit 34 is linearly operated to shift its posture, a necessary space for shifting the posture of the operation guide unit 34 can be reduced. Accordingly, the drawer unit 3 can be downsized.

(8) Operation and Effect 8

Since the main portion 35, the operation portion 36, and the guide portion 37 are integrally formed, the operation guide unit 34 can be reliably shifted between the first posture and the second posture when the operation portion 36 is operated. Further, compared with a structure that the main portion 35, the operation portion 36, and the guide portion 37 are separately formed, less parts and components are required to provide the operation guide unit 34. Accordingly, the operation guide unit 34 can be downsized.

(9) Operation and Effect 9

The operation guide unit 34 includes the opposing portion 39 functioning as the retaining portion for retaining the toner cartridge 11 in the drawer unit 3 (for retaining the toner cartridge 11 in the developing unit 7). That is, the opposing portion 39 confronts the leading guided portion 64 of the toner cartridge 11 and positioned upstream of the leading guided portion 64 in the second direction when the operation guide unit 34 is in the second posture. Therefore, while the operation guide unit 34 is in the second posture, movement of the toner cartridge 11 toward a downstream side in the second direction can be restrained. As a result, the toner cartridge 11 can be prevented from being removed from the drawer frame 31 while the operation guide unit 34 is in the second posture.

(10) Operation and Effect 10

Further, the drawer unit 3 is provided with the pair of drawer unit pressure members 101 (101L, 101R) for pressing the toner cartridge 11 toward the developing unit 7. Hence, when the toner cartridge 11 is mounted in the developing unit 7 in the first direction, the pair of drawer unit pressure members 101 presses the toner cartridge 11 toward the corresponding developing unit 7 with a suitable force. With this configuration, the toner cartridge 11 is temporarily fixed to the corresponding developing unit 7. Thus, unintentional removal of the toner cartridge 11 from the drawer unit 3 can be prevented. Further, when the drawer unit 3 is moved, the pair of drawer unit pressure members 101 can prevent unwanted rattling of the toner cartridge 11, thereby avoiding separation of the toner seal 71 from the frame seal 102 caused by the rattling. As a result, toner leakage from a portion between the toner seal 71 and the frame seal 102 can be restrained.

(11) Operation and Effect 11

The second direction is coincident with the pressing direction of the developing roller 9 toward the surface of the photosensitive drum 5. This second direction is provided by the combination of the main casing pressure member 20, the inclination of the guide groove 38, and the guided portions 64. Hence, any load directed in a direction crossing the second direction is not applied to the toner cartridge 11 during movement of the toner cartridge 11 toward and away from the photosensitive drum 5. Accordingly, stable movement of the toner cartridge 11 can be realized when the developing roller 9 is pressed or separated relative to the photosensitive drum 5.

9. Modifications

The toner cartridge 11 is not limited to the structure shown in FIG. 6. For example, a structure shown in FIGS. 13 through 16 is also available. The toner cartridge 11 shown in FIG. 6, the left side surface 56 of the casing 51 is provided with the boss 61, and the drive force generation gear 62 and the disk plate 63 are supported to the boss 61. Instead of this structure, a toner cartridge 11' has a base portion 111 that is formed in a generally rectangular-parallelepiped shape and rotatably supported to the boss 61. The base portion 111 has a left side surface on which two guided portions 112 are provided. The two guided portions 112 are provided at positions in confrontation with each other, interposing the boss 61 therebetween. That is, the two guided portions 112 are spaced apart from each other at an angle of 180 degrees about the boss 61. Each of the guided portions 112 has a columnar shape, and protrudes leftward from the left side surface of the base portion 111.

In the modification shown in FIGS. 13 through 16, instead of the operation guide unit 34 in the foregoing embodiment, an operation guide unit 34' shown in FIG. 14 is available. The operation guide unit 34' has the main portion 35, the operation portion 36 and the guide portion 37 formed with the guide groove 38 similar to the foregoing embodiment. The main portion 35 has a gear portion 113 along a part of an outer peripheral surface thereof. More specifically, the gear portion 113 and the guide portion 37 are provided at one side of the main portion 35, and the operation portion 36 is provided at another side thereof. The gear portion 113 extends to cover the guide groove 38 like a peaked roof, and has an arcuate shape with a center angle of 90 degrees, and is arranged to extend along an outer circumferential surface of the guide portion 37. The gear portion 113 has an outer circumferential surface provided with gear teeth 114. Further, in the modification, a first transmission gear 92 in the above-described embodiment is not provided. That is, in this modification, the drive force transmission mechanism 91 only includes the second transmission gear 93 and the third transmission gear 94.

Figure 15:
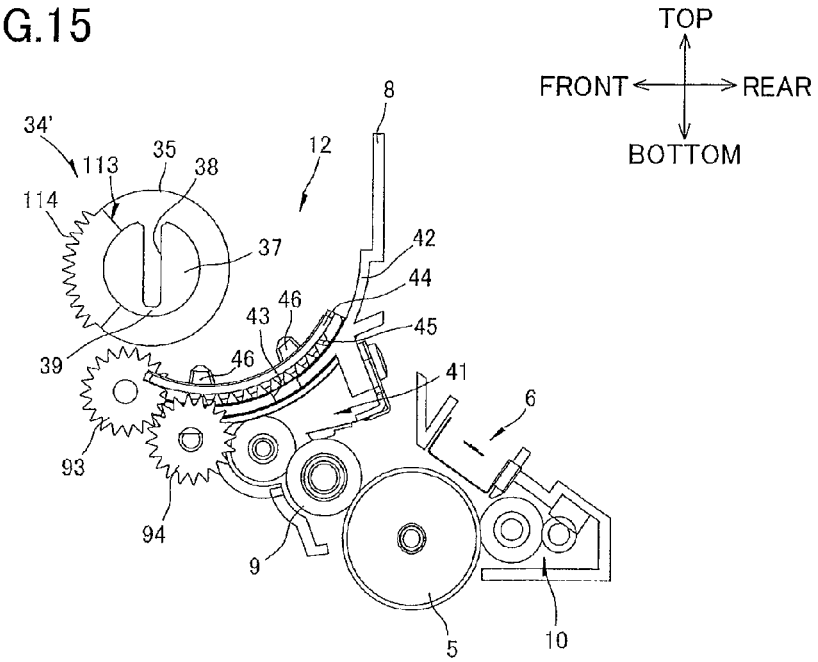
FIG. 15 is a partial cross-sectional view of the drawer unit in which the toner cartridge shown in FIG. 13 is mounted, wherein the operation guide unit is in a first posture.

When the toner cartridge 11' is not mounted in the space 12 formed in the drawer frame 31, as shown in FIG. 15, the operation guide unit 34' is in the first posture in which the guide groove 38 extends in the first direction (upper-to-lower direction) and the opposing portion 39 is positioned below the guide groove 38.

In the first posture, the gear portion 113 is disposed diagonally above and forward of the second transmission gear 93, and the gear teeth 114 is not meshingly engaged with the second transmission gear 93.

Figure 13:
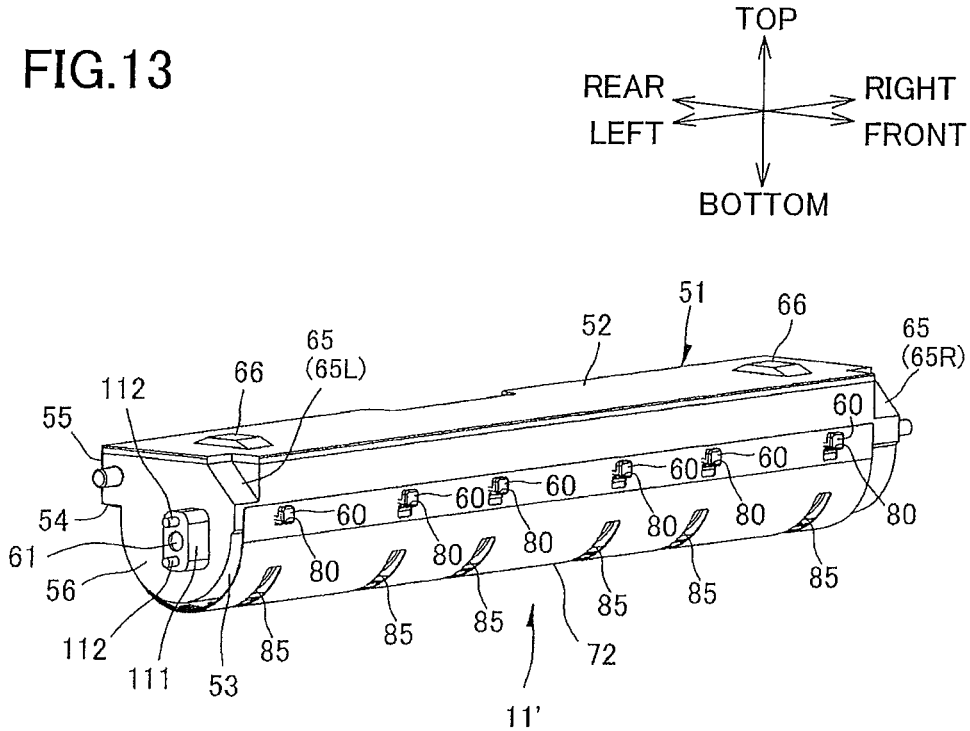
FIG. 13 is a perspective view of a toner cartridge according to a modification.

When the toner cartridge 11' is not mounted in the drawer unit 3, the shutter 73 is in the closed position. Further, as shown in FIG. 13, the two guided portions 112 are aligned in the first direction.

Figure 16:
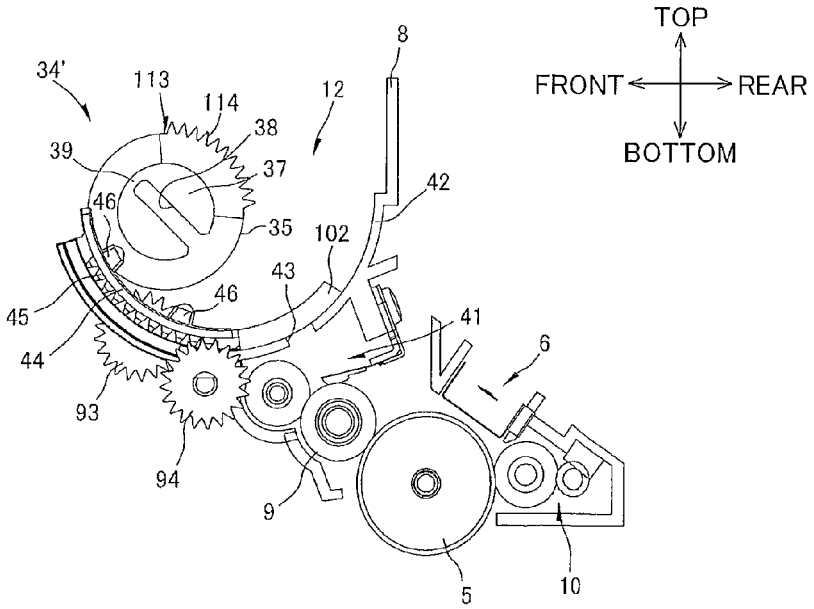
FIG. 16 is a partial cross-sectional view of the drawer unit in which the toner cartridge shown in FIG. 13 is mounted, wherein the operation guide unit is in a second posture.

After the two guided portions 112 have been inserted into the guide groove 38 from above and the toner cartridge 11' has been mounted in the space 12, the user holds the operation portion 36 by his/her fingers to angularly rotate the operation guide unit 34' in the counterclockwise direction in FIG. 15. Accordingly, the operation guide unit 34' is shifted to the second posture as shown in FIG. 16 from the first posture.

In association with the shift of the operation guide unit 34' to the second posture from the first posture, the guide groove 38 extends in the second direction that inclines diagonally downward and rearward. The opposing portion 39 is positioned upstream of the guided portions 112 in the second direction. Further, while the operation guide unit 34' angularly rotates to shift its posture, the gear teeth 114 of the gear portion 113 is brought into meshedly engagement with the second transmission gear 93. In association with the rotation of the operation guide unit 34', a rotational force is transmitted to the second transmission gear 93 from the gear teeth 114, and then to the third transmission gear 94 from the second transmission gear 93. As a result, the third transmission gear 94 rotates in the counterclockwise direction in FIG. 15. In association with the rotation of the third transmission gear 94, the shutter drive assembly 44 moves forward to a position forward of the openings 43 from a position opposing the openings 43. In association with the movement of the shutter drive assembly 44, the shutter 73 moves forward from the closed position along with the shutter drive assembly 44. The shutter 73 is thus positioned at the open position. When the operation guide unit 34' is in the second posture, the gear portion 113 is disposed diagonally above and rearward of the second transmission gear 93. Further, meshing engagement of the gear teeth 114 with the second transmission gear 93 has been released before the operation guide unit 34' is set to the second posture.

When the operation guide unit 34' is returned to the first posture from the second posture, the gear teeth 114 of the gear portion 113 is again brought into meshedly engagement with the second transmission gear 93 while the operation guide unit 34' angularly rotates. In association with further angular rotation of the operation guide unit 34', the shutter 73 is moved to the closed position from the open position by performing, in reverse order, the operation when the toner cartridge 11' is mounted in the space 12.

Accordingly, the same operation and effect can be obtained even if the toner cartridge 11' shown in FIG. 13 and the operation guide unit 34' shown in FIG. 14 are adopted in place of the toner cartridge 11 shown in FIG. 6 and the operation guide unit 34 shown in FIG. 4.

In the above-described embodiment, the four operation guide units 34 are provided on the left side plate 32. However, the operation guide units 34 may be provided both on the left side plate 32 and the right side plate 33. In accordance therewith, the guided portions 64 may be provided both on the left side surface 56 and the right side surface 57 of the casing 51 of the toner cartridge 11.

In the above-described embodiment, mounting and dismounting direction (first direction) of the toner cartridge 11 is the same as the pressing direction provided by the main casing pressure member 20. However, the pressing direction can be different from the mounting and dismounting direction.

Further, the present invention may be applicable to a monochromatic laser printer instead of the color laser printer 1.

While the invention has been described in detail with reference to the embodiment thereof, it would be apparent to those skilled in the art that various changes and modifications may be made therein without departing from the scope of the invention.

What is claimed is:

1. A process unit comprising:

a photosensitive member having an axis extending in an axial direction and a surface;

a developing unit having a developing agent bearing member for bearing a developing agent to be supplied to the surface of the photosensitive member;

a developer cartridge including:

a casing defining an internal space for accommodating the developing agent, and a pressed portion provided at the casing and configured to be pressed by an external force, the developer cartridge being mountable on or detachable from the developing unit in a first direction, and further configured to be pressed in a second direction different from the first direction upon application of pressure to the pressed portion by the external force, the second direction being coincident with a direction of pressing the developing agent bearing member against the surface of the photosensitive member;

a guide portion positioned on one side in the axial direction and shiftable between a first posture for guiding the developer cartridge to move relative to the developing unit in the first direction, and a second posture for guiding the developer cartridge to move relative to the developing unit in the second direction; and an operation portion configured to be operated to selectively shift the guide portion to one of the first posture and the second posture, wherein the casing is formed with an opening for supplying the developing agent accommodated in the internal space to the developing unit, wherein the developer cartridge further comprises a shutter movable between an open position for opening and a closed position for closing the opening, wherein the process unit further comprising a drive mechanism configured to move the shutter to the open position from the closed position when the guide portion is shifted to the second posture from the first posture in association with operation of the operation portion and to move the shutter to the closed position from the open position when the guide portion is shifted to the first posture from the second posture in association with operation of the operation portion.

2. The process unit as claimed in claim 1, wherein the developer cartridge further comprises a developer seal surrounding a periphery of the opening, the developer seal being disposed between the casing and the shutter when the shutter is in the closed position.

3. The process unit as claimed in claim 1, wherein the drive mechanism includes a plurality of gears.

4. The process unit as claimed in claim 1, wherein the developer cartridge further comprises a guided portion configured to be guided by the guide portion, wherein the drive mechanism includes a drive force generation member integrally provided with the guided portion and configured to generate a drive force to move the shutter in association with shift of the guide portion between the first posture and the second posture.

5. The process unit as claimed in claim 1 , wherein the drive mechanism includes a drive force generation member provided in the operation portion and configured to generate a drive force to move the shutter in association with operation of the operation portion.

6. The process unit as claimed in claim 1, wherein the guide portion is configured to be rotatable so as to shift between the first posture and the second posture.

7. The process unit as claimed in claim 1, wherein the operation portion and the guide portion are integral with each other.

8. The process unit as claimed in claim 1, wherein the developer cartridge further comprises a guided portion that is configured to be guided by the guide portion, wherein the guide portion includes an opposing portion that opposes the guided portion, in which the opposing portion is positioned upstream of the guided portion in the second direction when the guide portion is in the second posture.

9. The process unit as claimed in claim 1, further comprising a pressure member configured to press the developer cartridge toward the developing unit.

10. An image forming device comprising:

a main casing; and a process unit detachably attached to the main casing, and comprising:

a photosensitive member having an axis extending in an axial direction and a surface;

a developing unit having a developing agent bearing member for bearing a developing agent to be supplied to the surface of the photosensitive member;

a developer cartridge including:

a casing defining an internal space for accommodating the developing agent, and a pressed portion provided at the casing and configured to be pressed by an external force, the developer cartridge being mountable on or detachable from the developing unit in a first direction, and further configured to be pressed in a second direction different from the first direction upon application of pressure to the pressed portion by the external force, the second direction being coincident with a direction of pressing the developing agent bearing member against the surface of the photosensitive member;

a guide portion positioned on one side in the axial direction and shiftable between a first posture for guiding the developer cartridge to move relative to the developing unit in the first direction, and a second posture for guiding the developer cartridge to move relative to the developing unit in the second direction; and an operation portion configured to be operated to selectively shift the guide portion to one of the first posture and the second posture, wherein the casing is formed with an opening for supplying the developing agent accommodated in the internal space to the developing unit, wherein the developer cartridge further comprises a shutter movable between an open position for opening the opening and a closed position for closing the opening, wherein the process unit further comprising a drive mechanism configured to move the shutter to the open position from the closed position when the guide portion is shifted to the second posture from the posture in association with operation of the operation portion and to move the shutter to the closed position from the open position when the guide portion is shifted to the first posture from the second posture in association with operation of the operation portion.

11. The image forming device as claimed in claim 10, further comprising a pressure member that is provided in the main casing and configured to press the developer cartridge toward the developing unit when the process unit is attached to the main casing.

* * * * *